US010112067B2

(12) United States Patent
Golesh

(10) Patent No.: US 10,112,067 B2
(45) Date of Patent: Oct. 30, 2018

(54) EXERCISE MACHINE WITH MULTI-FUNCTION WHEEL BRAKE ACTUATOR AND OVER CENTER LOCKING MECHANISM

(71) Applicant: Foundation Fitness, LLC, Portland, OR (US)

(72) Inventor: Eric Golesh, Arvada, CO (US)

(73) Assignee: Foundation Fitness, LLC, Portland, OR (US)

( * ) Notice: Subject to any disclaimer, the term of this patent is extended or adjusted under 35 U.S.C. 154(b) by 0 days.

(21) Appl. No.: 15/926,907

(22) Filed: Mar. 20, 2018

(65) Prior Publication Data

US 2018/0207468 A1 Jul. 26, 2018

Related U.S. Application Data

(63) Continuation-in-part of application No. 14/643,792, filed on Mar. 10, 2015, now Pat. No. 9,919,182.

(60) Provisional application No. 62/644,194, filed on Mar. 16, 2018.

(51) Int. Cl.

| | |
|---|---|
| ***A63B 22/06*** | (2006.01) |
| ***A63B 21/012*** | (2006.01) |
| ***A63B 21/00*** | (2006.01) |

(52) U.S. Cl.

CPC .... *A63B 21/0125* (2013.01); *A63B 21/00072* (2013.01); *A63B 22/0605* (2013.01)

(58) Field of Classification Search

CPC ..... A63B 22/0605; A63B 21/0051; A63B 21/0125; A63B 21/00069; A63B 2225/09; A63B 2225/093; A63B 21/225; A63B 21/00072; A63B 2071/0081; A63B 21/023

See application file for complete search history.

(56) References Cited

U.S. PATENT DOCUMENTS

| | | | | | |
|---|---|---|---|---|---|
| 3,953,025 | A * | 4/1976 | Mazman | A63B 21/015 | 482/118 |
| 4,007,927 | A * | 2/1977 | Proctor | A63B 21/015 | 482/63 |
| 4,113,221 | A * | 9/1978 | Wehner | A47C 3/34 | 248/408 |
| 4,206,914 | A * | 6/1980 | Lee | A63B 21/0125 | 482/65 |
| 4,364,557 | A * | 12/1982 | Serati | A63B 71/06 | 482/65 |

(Continued)

*Primary Examiner* — Garrett Atkinson
(74) *Attorney, Agent, or Firm* — Polsinelli PC

(57) ABSTRACT

An exercise machine, such as indoor cycle, includes a multi-function wheel brake actuator. A braking force is induced on a wheel by finely or coarsely adjusting the brake actuator. The brake actuator may include a knob whereby a user may finely adjust the braking force on the wheel and a lever to actuate interval settings whereby the brake actuator provides set positions of braking resistance. The lever may include a spacer to reduce friction of the lever. The exercise machine may further include a pop-pin assembly with an over-center cam mechanism to clamp members together. The pop-pin assembly also includes a fine adjustment to adjust the clamping force. Implementations of the pop-pin assembly may be arranged to apply the clamping force by pivoting a lever of the pop-pin assembly either toward or away from the members being fixed.

20 Claims, 31 Drawing Sheets

(56) References Cited

U.S. PATENT DOCUMENTS 4,408,613 A * 10/1983 Relyea ..... A61B 5/222 482/5
4,417,724 A * 11/1983 Bikker ..... A63B 21/015 188/251 A
4,595,198 A * 6/1986 Sparks ..... A63B 21/015 188/184
4,673,177 A * 6/1987 Szymski ..... A63B 21/015 482/119
5,007,675 A * 4/1991 Musto ..... B62J 1/08 297/215.14
5,031,901 A * 7/1991 Saarinen ..... A63B 21/0051 310/191
5,466,203 A * 11/1995 Chen ..... A63B 21/0051 482/57
5,916,067 A * 6/1999 Morasse ..... A63B 69/16 482/61
6,491,606 B1 * 12/2002 Swift ..... A63B 22/0605 482/57
6,659,486 B2 * 12/2003 Eschenbach ..... B62K 3/002 280/221
7,172,532 B2 * 2/2007 Baker ..... A63B 22/0605 403/109.1
7,314,434 B2 * 1/2008 Chen ..... A63B 21/0051 188/164
7,364,533 B2 * 4/2008 Baker ..... A63B 22/0605 248/408
7,470,220 B2 * 12/2008 Hernandez ..... A63B 21/012 188/25
7,803,095 B1 * 9/2010 LaGree ..... A63B 22/0089 482/121
8,052,581 B1 * 11/2011 Lohr ..... A63B 21/015 482/63
8,585,561 B2 * 11/2013 Watt ..... A63B 21/0051 482/57
8,641,585 B2 * 2/2014 LaGree ..... A63B 21/023 482/92
8,721,511 B2 * 5/2014 Endelman ..... A63B 21/156 482/121
8,834,324 B2 * 9/2014 Lull ..... A63B 21/015 482/15
9,327,162 B2 * 5/2016 Huang ..... A63B 22/06
9,604,095 B1 * 3/2017 Lagree ..... A63B 21/4035
2008/0234112 A1 * 9/2008 Hernandez ..... A63B 21/012 482/63
2010/0069205 A1 * 3/2010 Lee ..... A63B 21/0051 482/63
2010/0234185 A1 * 9/2010 Watt ..... A63B 21/0051 482/8
2010/0323850 A1 * 12/2010 Bingham, Jr. ..... A63B 21/225 482/63
2012/0088637 A1 * 4/2012 Lull ..... A63B 21/015 482/57
2012/0088638 A1 * 4/2012 Lull ..... A63B 21/015 482/57
2017/0113091 A1 * 4/2017 Lagree ..... A63B 22/0087
2017/0157452 A1 * 6/2017 Lagree ..... A63B 21/4035
2017/0157458 A1 * 6/2017 Lagree ..... A63B 22/0089
2017/0189740 A1 * 7/2017 Lagree ..... A63B 22/0087
2017/0246499 A1 * 8/2017 Lagree ..... A63B 22/0023

* cited by examiner

EXERCISE MACHINE WITH MULTI-FUNCTION WHEEL BRAKE ACTUATOR AND OVER CENTER LOCKING MECHANISM

CROSS REFERENCE TO RELATED APPLICATION

The present non-provisional utility application is a continuation-in-part of U.S. patent application Ser. No. 14/643,792 titled "Exercise Machine with Multi-Function Wheel Brake Actuator and Over Center Locking Mechanism," filed on Mar. 10, 2015, now U.S. Pat. No. 9,919,182, which is hereby incorporated by reference herein. The present application further claims priority under 35 U.S.C. § 119 to provisional application No. 62/644,194 titled "Exercise Machine with Multi-Function Wheel Brake Actuator and Over Center Locking Mechanism," filed on Mar. 16, 2018, which is hereby incorporated by reference herein.

TECHNICAL FIELD

Aspects of the present disclosure involve an exercise bicycle and a brake adjustment assembly and a locking assembly.

BACKGROUND

Indoor cycling is a popular and excellent way for people to maintain and improve fitness. Generally speaking, indoor cycling revolves around an exercise bicycle that is similar to other exercise bicycles with the exception that the pedals and drive sprocket are connected to a flywheel rather than some other type of wheel. Thus, while a user is pedaling, the spinning flywheel maintains some momentum and better simulates the feel of riding a real bicycle. To further enhance the benefits of indoor cycling, fitness clubs often offer indoor cycling classes as a part of their group fitness programs. With such a program, an instructor guides the class through a simulated real world ride including simulating long steady flat sections and climbing. In either situation and whether or not in a class setting, the user simulates such riding conditions by adjusting the resistance on the flywheel—the amount of power required by the rider to turn the flywheel. Interval training, which involves a sequence of hard riding followed by recovery, is a popular and proven way to train but conventional indoor cycling bicycles do not provide a convenient and easy way rapidly and predictably change resistance of the flywheel. It is also important to provide an easy and effective mechanism to change the seat height and handlebar height to fit different riders.

It is with these issues in mind, among others, that aspects of the present disclosure were conceived.

SUMMARY

Aspects of the present disclosure involve an apparatus, such as an exercise machine, that includes a frame supporting a rotating member and a resistance element moveable between at least a first resistance element position and a second resistance element position. The first resistance element position is associated with a first resistance on the rotating member and the second resistance element position is associated with a second resistance on the rotating member, the second resistance being different than the first resistance. The exercise machine further includes a resistance adjustment assembly including a shaft coupled to the resistance element and translatable relative to the frame between a first shaft position and a second shaft position. The first shaft position corresponds to the first resistance element position and the second shaft position corresponds to the second resistance element position. The resistance adjustment assembly further includes a lever assembly operably coupled with the shaft and that is independently rotatable from the shaft. The lever assembly is rotatable between a first lever position and a second lever position to translate the shaft between the first shaft position and the second shaft position.

In another aspect of the present disclosure an exercise machine is provided that includes a frame supporting a wheel and a brake arm pivotally coupled with the frame. The brake arm assembly is moveable between at least a first position and a second position and includes at least one resistance element positioned proximate the wheel. The first position of the brake arm assembly is associated with a first braking force on the wheel while the second position is associated with a second braking force on the wheel, the second braking force being greater than the first braking force. The exercise machine further includes a brake arm adjustment assembly that includes a housing coupled with the frame and that translationally and rotatably supports a shaft. The brake arm adjustment assembly further includes a member operably fixed relative to the housing that defines a first surface separated from a second surface by a distance relating to a separation between the first position and the second position of the brake arm assembly. A lever assembly of the brake arm adjustment assembly includes at least one projection such that the lever assembly is moveable relative to the housing to selectively move the at least one projection from engaging the first surface to engaging the second surface. A spacer is disposed between the lever assembly and the shaft such that the lever assembly abuts the spacer and is rotatable about the spacer. Movement of the lever assembly causes the shaft to translate the distance separating the first surface and the second surface and move the brake arm from the first position, associated with the first surface, to the second position, associated with the second surface.

In yet another aspect of the present disclosure, an exercise apparatus is provided that includes a first member, a frame comprising a second member, the first member moveably supported by the frame relative to the second member, and a locking assembly coupled with the second member. The locking assembly includes a shaft including an engagement portion positioned to engage the first member to fix the first member relative to the second member and a cam roller coupled to the shaft. The locking assembly further includes a drive shaft defining a passage receiving the shaft, the shaft adjustably supported within the passage such that the shaft is translatable within the passage relative to the drive shaft. A lever of the locking assembly defines a cam slot and is coupled to the drive shaft by insertion of the cam roller into the cam shaft. The lever is pivotally supported by a pivot axle such that the lever is pivotal between a first lever position where the drive shaft is driven toward the first member to fix the first member relative to the second member and a second lever position where the drive shaft is released from driving the first member such that the first member may be moved relative to the second member.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however the emphasis instead is being placed on illustrating the principles of the inventive concepts. It is intended that the embodiments and figures disclosed herein are to be considered illustrative rather than limiting.

DETAILED DESCRIPTION

Aspects of the present disclosure involve an exercise machine, such as an indoor cycle, and mechanisms for adjusting braking resistance of a wheel or fixing one member relative to another member. With respect to the adjustment of braking resistance, a multifunction brake actuator is provided that allows a user to both finely adjust braking force and coarsely adjust braking force, which may be useful for interval training when used in an exercise bicycle. Generally speaking, the exercise machine includes a flywheel and a brake arm that may be moved relative to the brake arm to position magnets to induce a braking force on the flywheel through eddy currents. The brake actuator, however, may also be used with a friction resistance element to create a frictional braking force on a wheel. A person using the exercise machine must use some amount of power to overcome the induced braking force. The brake actuator allows a user to finely adjust the braking force by rotating a knob. The brake actuator also allows a user to turn a lever to coarsely adjust the brake arm between one of a plurality (e.g., three interval settings) different interval settings where different set resistances are placed on the wheel. The baseline for the interval settings may be established by fine adjustment.

The user may also fix one member to another member through a locking assembly, which may be a pop-pin assembly. To adjust the height of a seat or handlebars, for example, the locking assembly is released so that the seat or handlebars may be raised or lowered. When adjusted properly, the user engages the pin assembly to lock the members. Unlike conventional pin assemblies used in exercise equipment, such as exercise bicycles but also including weight machines and other equipment, the pin assembly includes an over-center cam assembly that allows a user to lever a pin into a hole to tightly couple any two members. Moreover, the pin assembly includes a fine adjustment that allows a user to adjust the clamping force.

Figure 1:
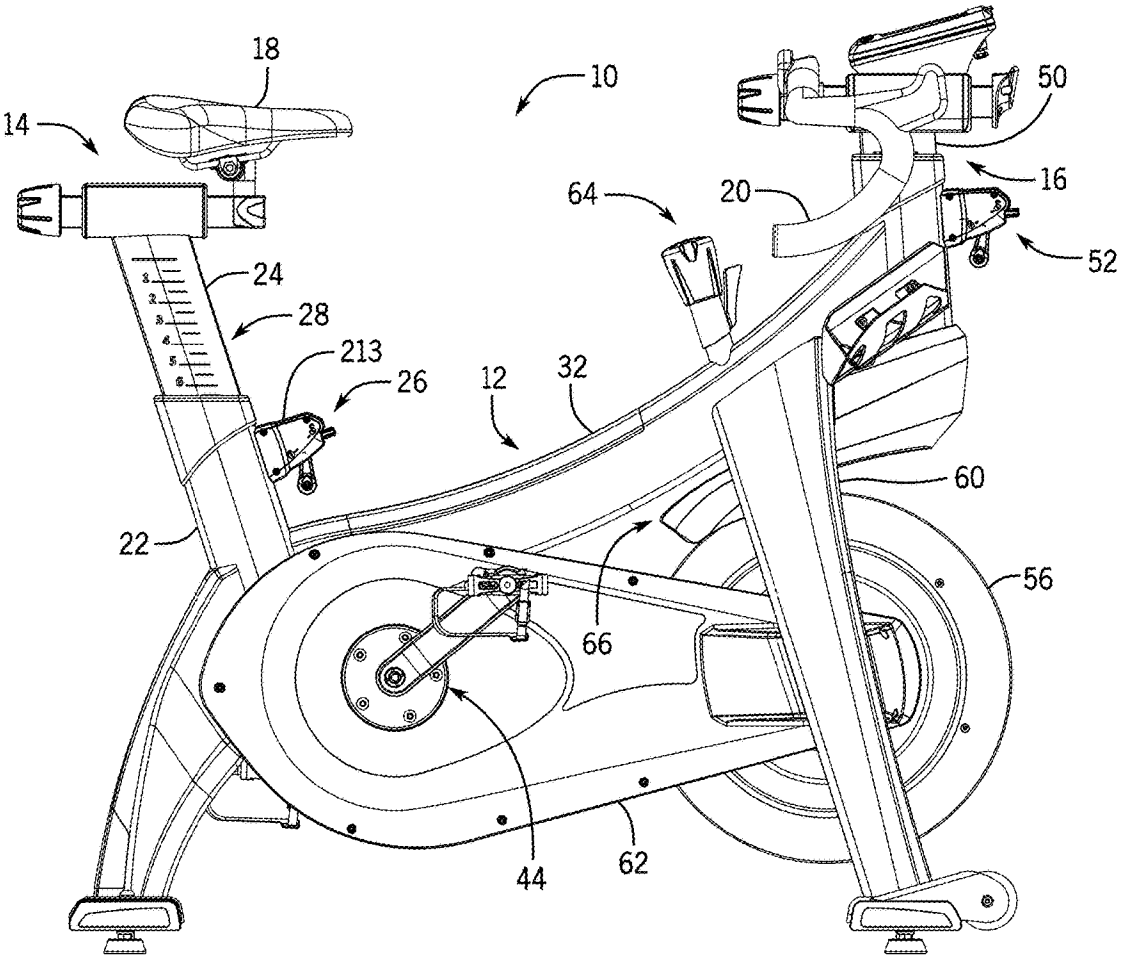
FIG. 1 is a right side view of an exercise bicycle.
Figure 2:
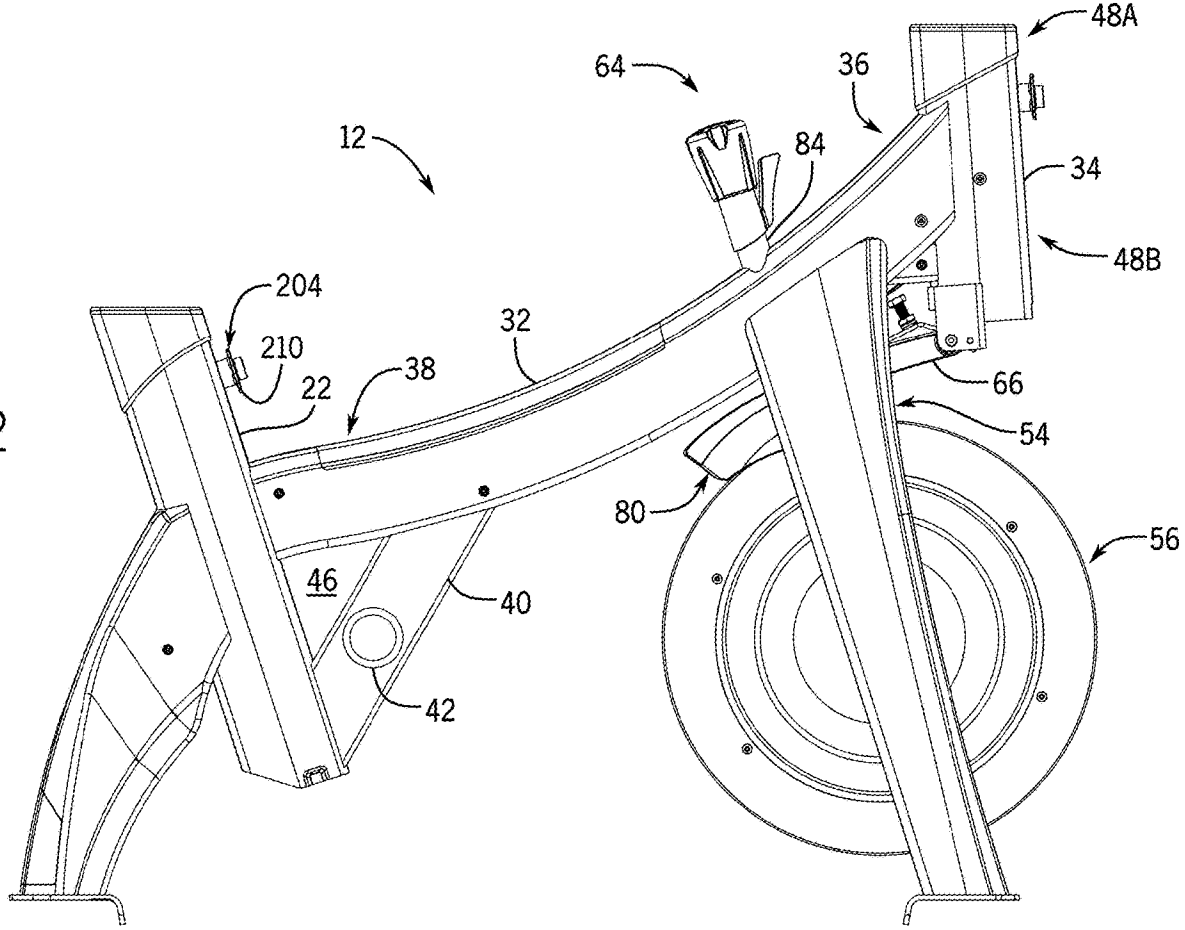
FIG. 2 is a right side view of an exercise bicycle frame of the exercise bicycle shown in FIG. 1.

Referring now to FIGS. 1 and 2, one example of an exercise bicycle 10 is shown. Various concepts discussed herein reference an exercise bicycle and particularly an indoor cycling style exercise bicycle; however, the concepts are applicable to other exercise machines. The exercise bicycle is configured for use by a variety of riders in a club environment or for a single or limited number of riders in a home or other personal use environment. The exercise bicycle includes a frame 12 adjustably supporting an adjustable seat assembly 14 at the rear of the frame and adjustably supporting an adjustable handlebar assembly 16 at the front of the frame. The adjustable seat and handlebar assemblies provide fore and aft adjustment of a respective seat 18 and handlebar 20. Further, the seat and handlebar assemblies may be vertically adjusted and fixed at various possible positions. Hence, the exercise bicycle provides for many different possible seat and handlebar positions to fit different riders and to provide riders with different configurations depending on the exercise being performed. Examples of seat and handlebar adjustment assemblies that may be used are described in U.S. Pat. No. 8,827,871 titled "Exercise Bicycle Frame with Bicycle Seat and Handlebar Adjustment Assemblies," issued on Sep. 9, 2014, which is hereby incorporated by reference herein.

The frame includes a seat tube 22 that receives a seat post or "stem" portion 24 of the seat assembly 14. The seat post may be moved up and down relative to the seat tube to adjust the height of the seat assembly, and particularly to adjust the height of the seat 18 that is a part of the seat assembly. A pop pin 26 is connected with the seat tube (second member) and is configured to engage one of a plurality of apertures 28 defined in the seat post (first member), and thereby secure the seat at a desired height. The pop pin may be spring-loaded such that it is biased in the locked position engaging the aperture.

The pop pin is shown extending forwardly from the seat tube. This configuration provides easy access for a rider to adjust the seat up or down. In many instances, ease of seat height adjustment is simply to accommodate riders of different heights. The pop pin is positioned for easy access by the rider. It is possible, however, to position the pop pin on the back side of the seat tube or at another location. Additionally, it is possible to use other mechanisms to facilitate seat height adjustment with or without pop pins. For example, a pawl on the fore and aft seat and handlebar assemblies may be used to vertically adjust the seat post (or tube) as well as the handlebar post.

In one particular implementation, the seat tube is rearwardly angled at approximately 72 degrees. The seat tube angle, along with other adjustment and dimensional relationships discussed herein, is optimized so that riders of all sizes can best fit the exercise bicycle. The seat tube 22, along with other frame members discussed herein, is extruded aluminum. Other frame member shapes and materials may be used, such as steel square tubing or steel round tubing, in the construction of the frame assembly. However, the extruded aluminum race track shaped tubing provides a unique balance between strength, overall exercise bicycle weight and aesthetic appearance. Additionally, while the seat post is shown as telescoping out of the seat tube, this relationship may be reversed such that the post fits over the tube. This relationship may also be reversed for other tube and post arrangements discussed herein.

Returning again to the discussion of the frame 12 and referring primarily to FIG. 2, a down tube 32 extends from a lower rear area of the exercise bicycle to an upper forward area of the exercise bicycle. Particularly, the down tube extends between a mid-portion of the seat tube 22 and supports a head tube 34 at the forward end of the down tube. The down tube is also a racetrack type extruded aluminum member. The down tube, in one particular arrangement, is curved descending at a relatively steeper angle 36 at the head tube and curving to a shallower angle 38 at the seat tube. The down tube is welded to the seat tube, although other means of attachment and arrangements are possible. A bottom bracket tube 40 extends downward and rearward from the down tube to a bottom of the seat tube. The bottom bracket tube connects to the seat tube below the down tube. The bottom bracket tube supports a bottom bracket 42, which in turn supports a crank assembly 44. The bottom bracket tube, down tube and seat tube, collectively form a structurally rigid triangle 46.

The head tube 34 is connected to the front of the down tube 32. A portion 48A of the head tube extends upwardly from the down tube and a portion 48B of the head tube extends downwardly from the head tube. The head tube (second member) receives a handlebar post 50 (first member) that extends downwardly from the fore and aft adjustable handlebar assembly 16. The handlebar post may be moved vertically relative to the head tube to adjust the height of a handlebar assembly, and particularly to adjust the height of a handlebar 20 of the handlebar assembly. A second pop pin 52 is connected with the head tube 34 and is configured to engage one of a plurality of apertures (not shown) defined in the handlebar post, and hence secure the handlebars at a desired height. Other mechanisms may also be used in place of the pop pin, and the position of the pop pin or any other mechanism may be altered in alternative exercise bicycle implementations.

In the frame configuration illustrated herein, a front fork assembly 54, which supports a flywheel 56 between opposing left 58 and right 60 fork legs, is coupled to the down tube 32 at a point between the head tube 34 and the seat tube 22, and proximate the head tube. In the frame configuration shown, the forks are set at about the same angle as the seat tube. The exercise bicycle discussed herein is particularly configured for indoor cycling and therefore includes a flywheel. It is nonetheless possible to deploy the frame and other components discussed, whether alone or in combination, in an exercise bicycle that does not include a flywheel, to use different sized flywheels or to position the flywheel and frame members differently.

The exercise bicycle further includes the crank assembly 44 configured to drive the flywheel 56. A drive sprocket is rotatably supported in the bottom bracket 42. A belt (not shown, behind the cover 62) connects the drive sprocket to the flywheel sprocket, although other mechanisms, such as a chain, may be used to connect the sprockets. The drive sprocket is fixed to a pair of crank arms and the flywheel is fixed to the flywheel sprocket such that the drive sprocket and flywheel sprocket do not freewheel. Hence, clockwise rotational force on the crank arms, such as in conventional forward pedaling, rotates the flywheel in a clockwise manner. However, if the rider discontinues exerting a pedaling force on the cranks, the spinning flywheel will continue, via the belt, to drive the crank arms. It is, however, possible to include freewheel mechanisms with the drive or flywheel sprocket or other components. As discussed below, a rider may rapidly stop the spinning flywheel and the associated crank arm rotation by depressing a multi-function brake actuator 64.

Brake Actuator

Figure 3:
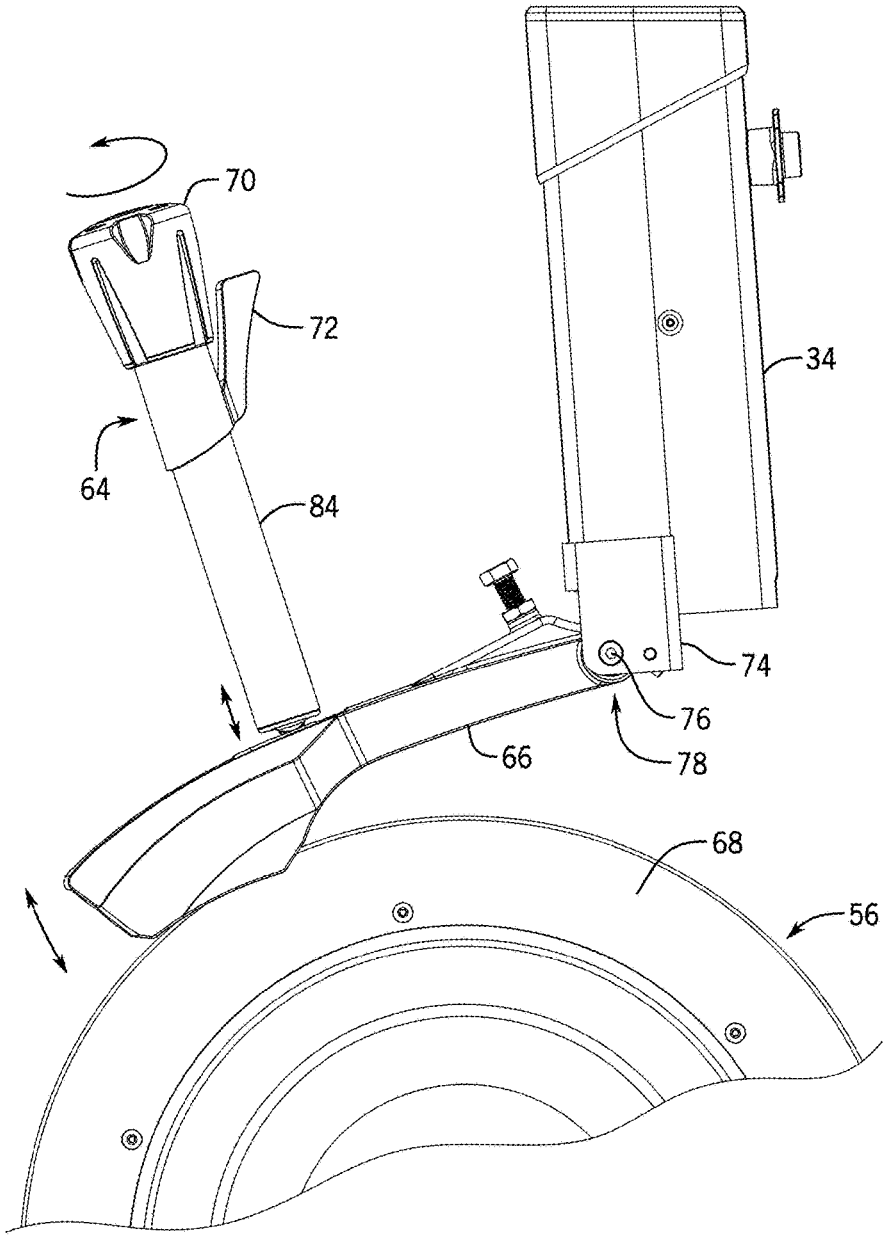
FIG. 3 is a right side view of a multifunction brake actuator assembly and some related components of the exercise bicycle of FIG. 1.

Referring first to FIG. 3, which has many of the bicycle components removed to better illustrate the brake actuator, brake arm 66, is controlled with a multi-function brake actuator 64. The brake arm supports one or more permanent magnets 67 that induce eddy currents in the flywheel, depending on the proximity of the magnets to the flywheel. The induced resistance on the flywheel by the relative position of the magnets determines how much power is required to spin the flywheel. The exercise bicycle or any other exercise machine using a rotating wheel, such as an elliptical machine or recumbent bike, may also use a brake arm that presses a friction element on a wheel to create a frictional resistance rather than a magnetic resistance. The friction element may be in the brake arm or provided directly by the brake actuator. Such an embodiment works similarly but the brake arm has a friction element, such as a felt pad or the like, that pushes on the wheel to create resistance. Rotating the knob in such an arrangement places greater force on the friction pad and hence induces greater resistance to rotation of the wheel. Referring again to the magnetic embodiment, in one example, rotation of the flywheel relative to the magnets induces eddy currents in the flywheel that creates braking power ranging from 40 watts, with little or no magnet induced resistive power, to about 700 watts or greater depending on the rpm of the flywheel when the magnets are positioned. The magnets are positioned adjacent to but not in contact with an outer ring 68 of the flywheel. In one particular arrangement, one or more pairs of magnets are positioned substantially equidistant from opposing sides of the flywheel. Braking power (and hence the amount of power required by a rider to spin the flywheel) may be adjusted depending on the position of the magnets relative to the flywheel. Generally speaking, the brake arm actuator is used to pivot the brake arm relative to the flywheel to adjust braking resistance or otherwise the power required to turn the flywheel.

Figure 4A:
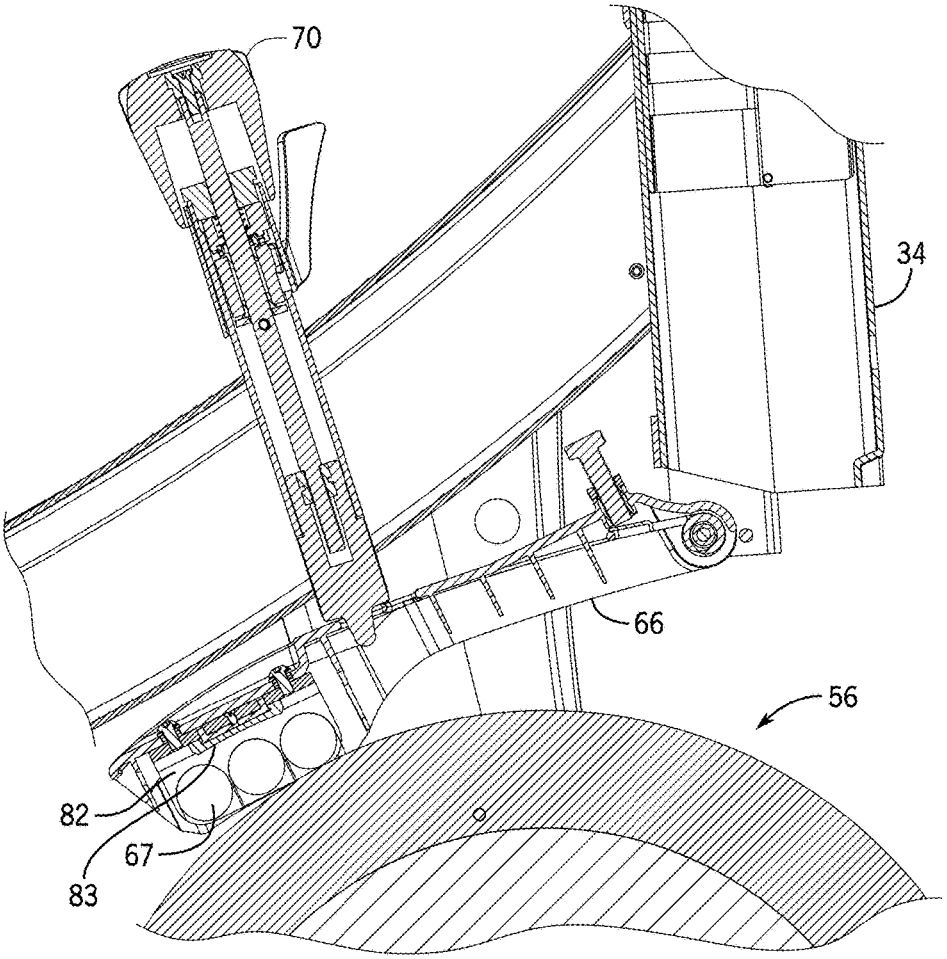
FIGS. 4A-4C are representative section views of a multifunction brake actuator assembly finely adjusting a brake arm at an upper (relatively lower braking force), mid and lower (relatively greater braking force) position relative to a flywheel, which is functionally equivalent to the multifunction brake actuator described in FIGS. 5-8, but is slightly mechanically different.
Figure 4B:
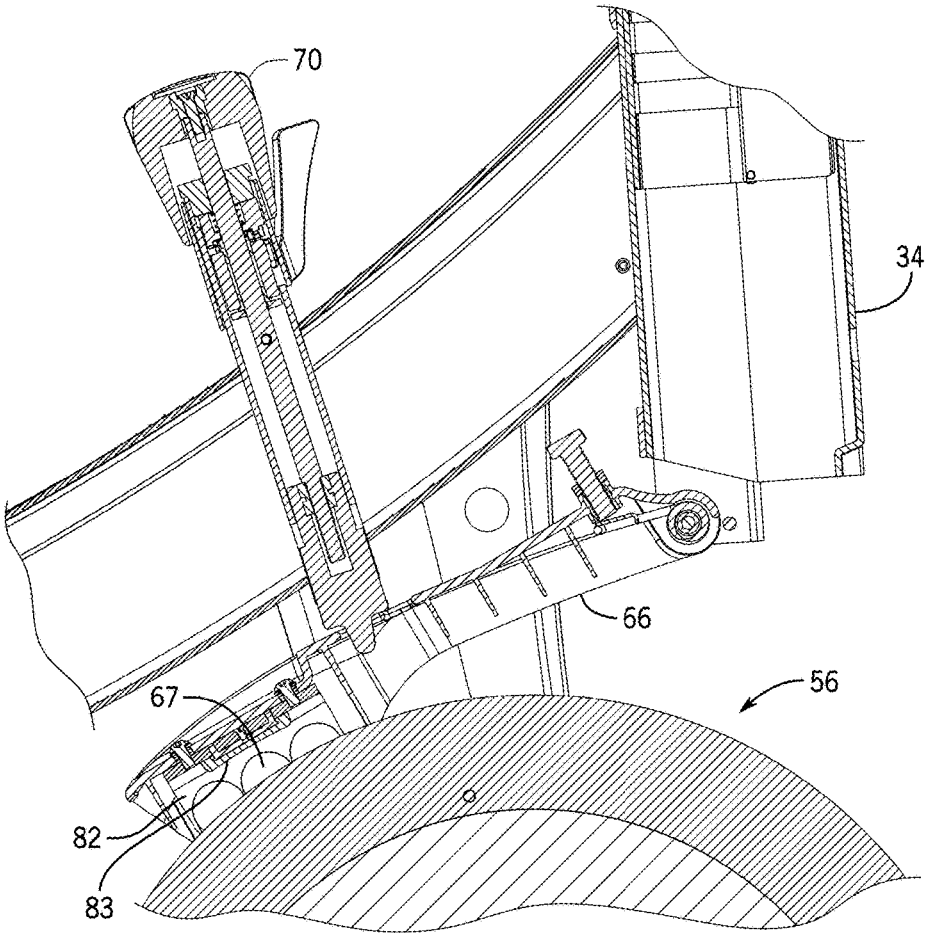
Figure 4C:
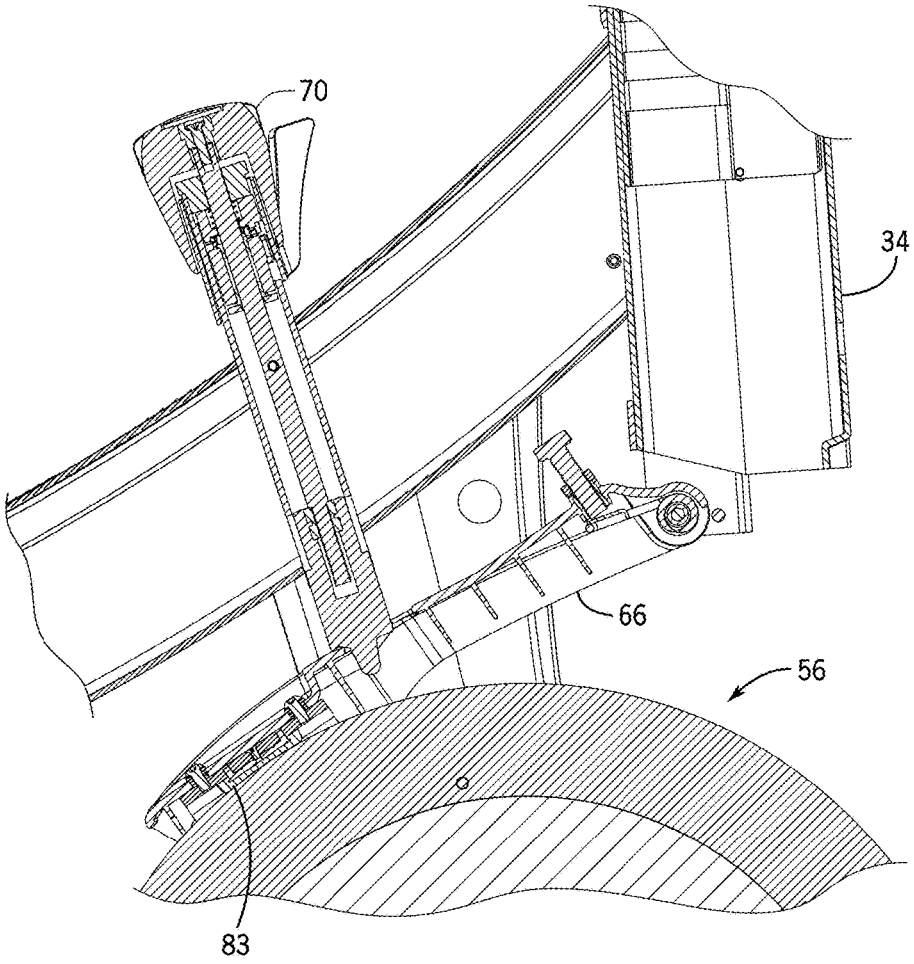
Figure 5A:
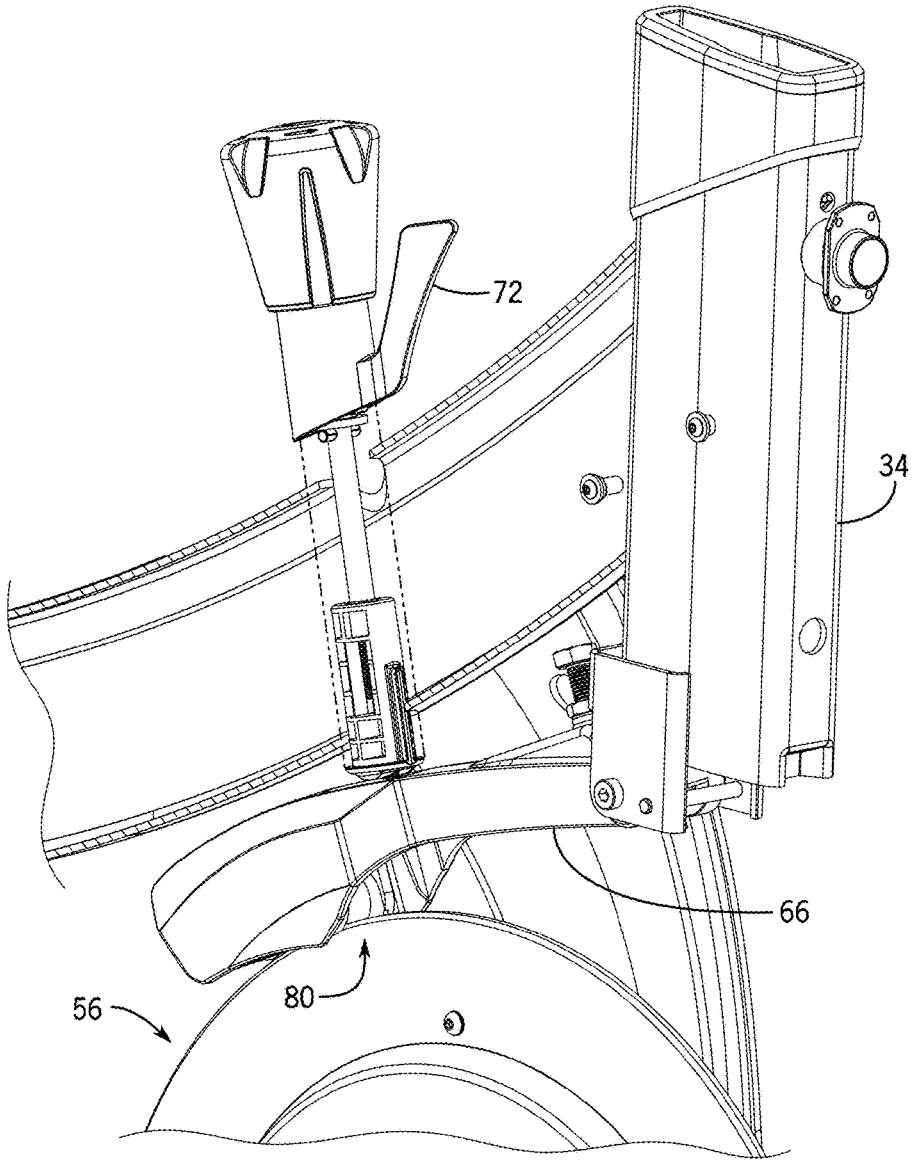
FIGS. 5A-5C are representative isometric views of a multifunction brake actuator assembly coarsely adjusted between three interval positions.
Figure 5B:
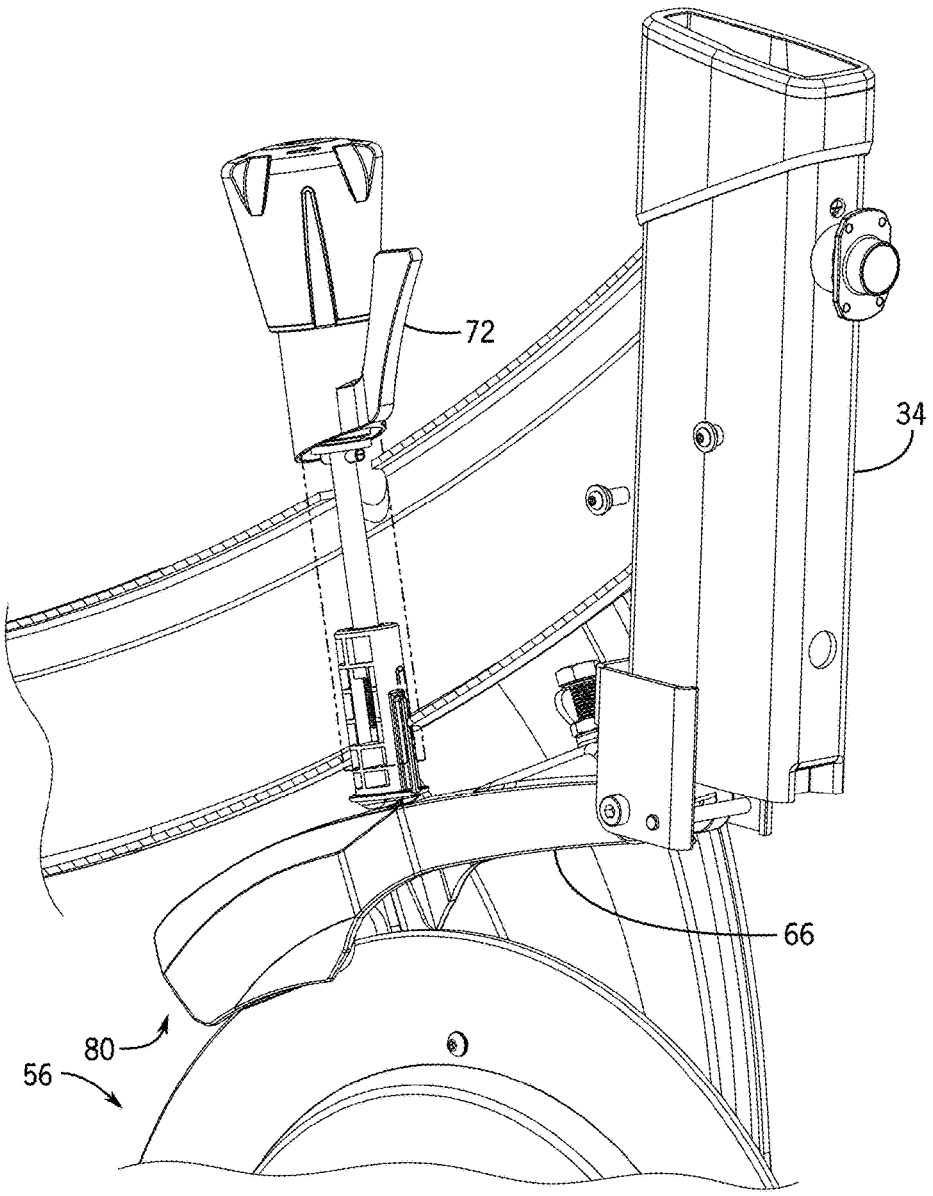
Figure 5C:
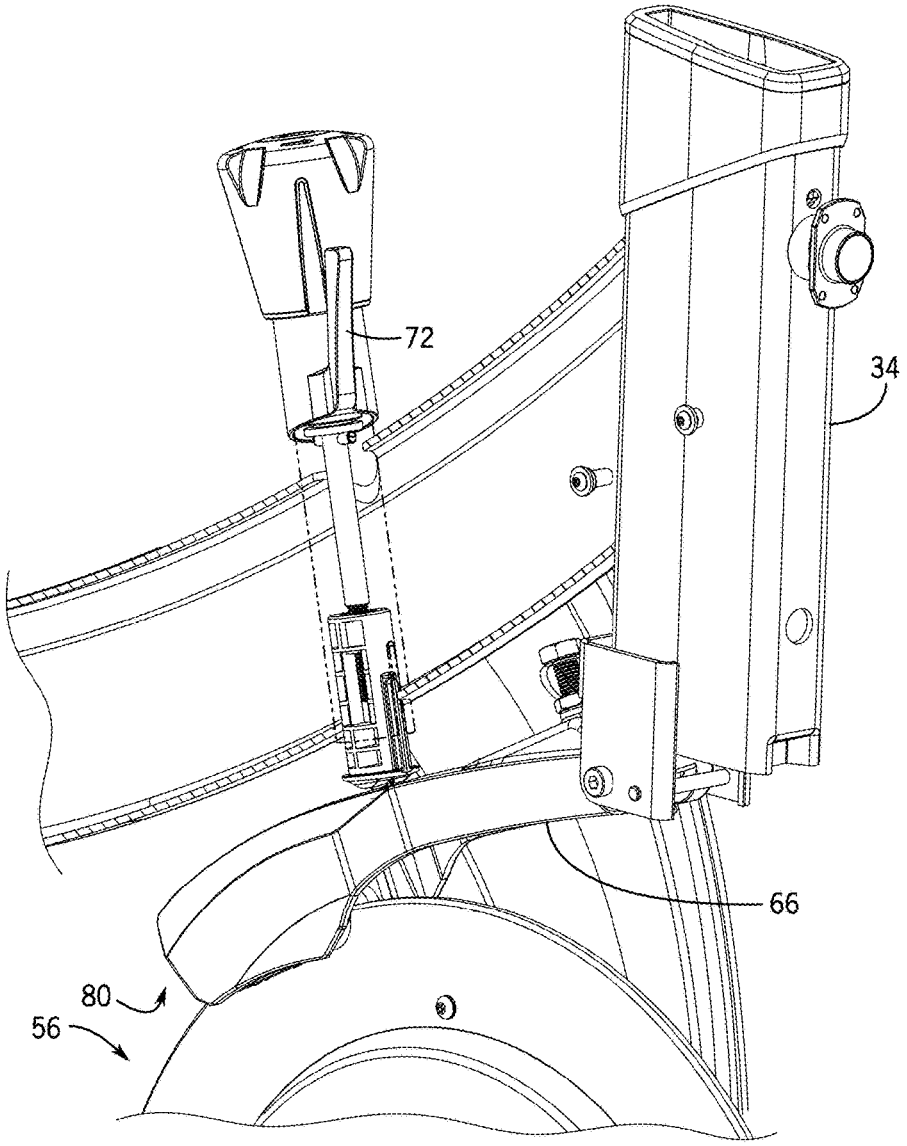
Figure 6:
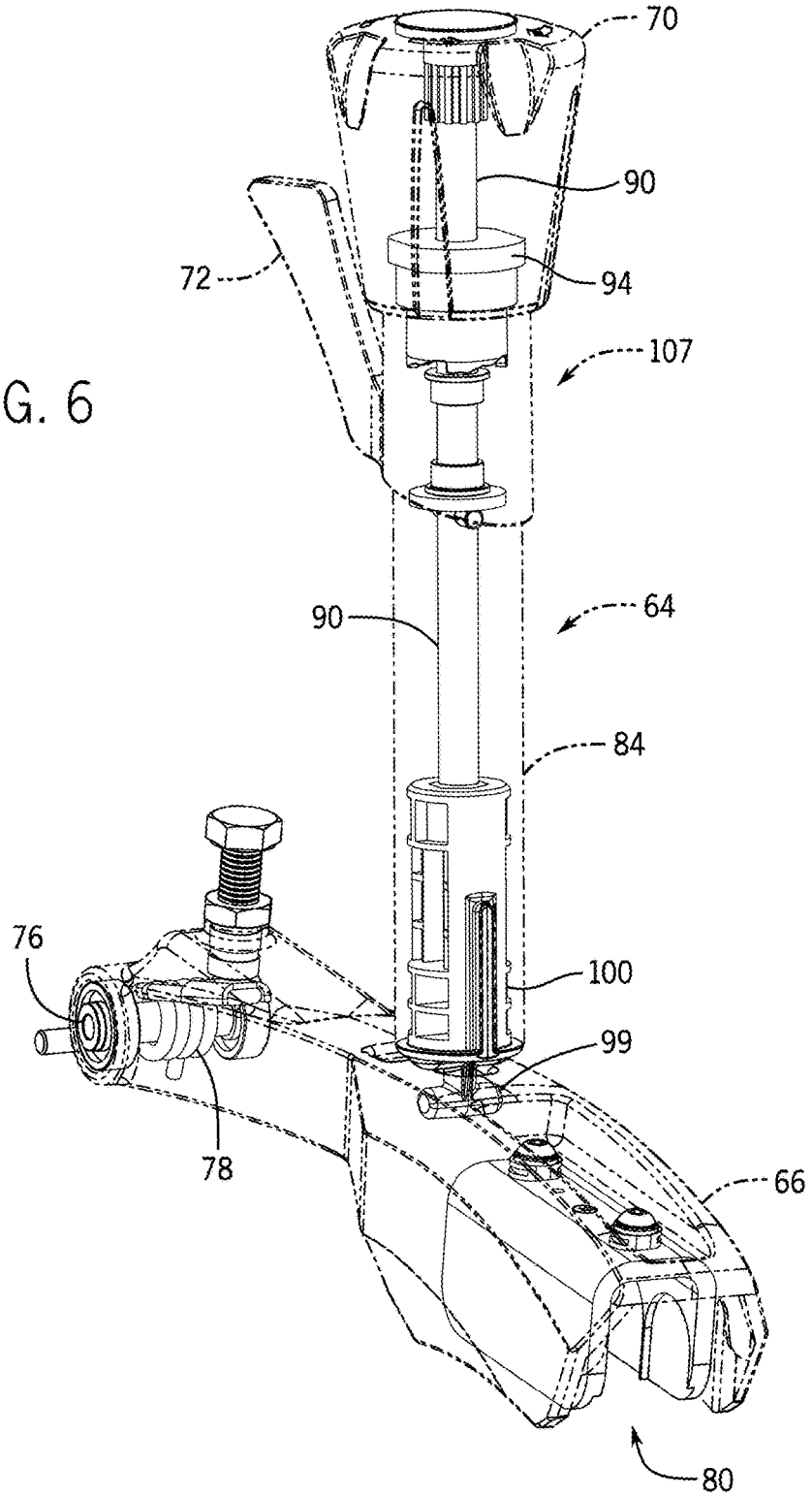
FIG. 6 is an isometric view of the multifunction brake actuator coupled with the brake arm.

The brake actuator 64 may provide fine adjustment, coarse adjustment, and provide for immediate flywheel braking to cause a complete stop, and hence is referred to herein as a multi-function actuator. It possible that an implementation may provide only one or two of the three disclosed functions, and hence may not be multi-function. Nonetheless, with reference to the multi-function brake actuator illustrated, a user may rotate a knob 70 to move the brake arm downward or upward and finely adjust the braking force imparted on the flywheel 56. FIGS. 4A, 4B, and 4C are section views of the brake actuator and brake arm (and other components) and illustrating the brake actuator finely adjusted at an upper most position (least braking resistance), a mid-position and a lower most position (greatest braking resistance). A user may also actuate an interval lever 72 to move the brake arm between a plurality of coarse adjustment settings where the brake arm moves a fixed distance between settings, and hence moves the brake arm between a plurality of different resistance settings. FIGS. 5A, 5B, and 5C illustrate the interval lever, the actuation of the brake actuator and the position of the brake arm in three possible interval positions (upper, middle and lower) associated with three relative degrees of braking resistance ranging from a relatively lower resistance, to a relatively higher resistance with a mid-level resistance between. Such a coarse adjustment may be useful in interval training where a user rides between a recovery resistance (the upper position) and one or more training resistances (the middle and lower positions) where it takes more power to spin the flywheel relative to the recovery resistance. Finally, the user may push down on the knob causing the actuator to press the brake arm down to engage a mechanical friction brake to stop the flywheel. Typically, such an action is used when the rider wants to quickly stop the flywheel from spinning, such as at the end of an exercise routine or if the rider wants to quickly dismount the exercise cycle for any number of reasons.

In one particular implementation, the brake arm 66 is pivotally mounted at a bracket 74 coupled with a bottom of the head tube 34. The brake arm extends rearwardly and downwardly from a pivot 76. In this way, or in other ways, a torsion spring 78 is coupled to the brake arm at the pivot 76 and provides an upward force on the brake arm, and also provides a return or upward force on components of the brake actuator as discussed in more detail herein. A coil spring, compression spring, extension spring, or other spring may be positioned between the brake arm and the frame to provide the return force.

Distal from the pivot, the brake arm has a clam shell opening 80 defining a channel configured to receive and secure a magnet assembly 82 housing the magnets 67. In the implementation illustrated, the brake arm is mounted generally above the flywheel, and the discussion herein refers to moving the brake arm downward or upward to induce more or less braking power, respectively. It should be recognized, however, that the brake arm and actuator may be positioned in various different ways to cause relative movement of the brake arm (and magnets) relative to the flywheel. For example, in a recumbent bike, the actuator might be positioned to face a seated rider, and the brake arm might move fore and aft to achieve resistance changes. Moreover, the brake actuator might be employed with magnets coupled directly to a feature of the brake actuator rather than a brake arm.

The pivotal position of the brake arm relative to the flywheel may be finely adjusted by way of the multifunction brake adjustment assembly. The brake actuator includes a tube 84 fixed to the down (or top) tube 32 of the exercise bicycle 10. Many of the functional components of the actuator are supported in, or relative to, the tube. The knob is coupled with a shaft 90 extending through the tube. The knob 70 defines a cavity 86 that fits over a top portion 88 of the support tube 84. In the implementation illustrated, the tube defines a circular cross section. However, the tube may be of other shapes and dimensions, and serves as a housing and structural support for various actuator components. Proximate the knob 70, the shaft 90 extends through a bore (or aperture) defined in a cap 92 pressed into the top of the tube. The end cap defines a top collar 94 above the tube and of approximately the same outer diameter as the tube 84. The collar retains the cap at the top of the tube. The cap also defines an extension 96 that extends within the tube and is about the same inside diameter of the tube. The cap may be press fit, threaded, or otherwise secured in the tube.

The shaft defines a threaded portion 98, distal the knob 70, to which is coupled a brake arm connector 100. The threaded portion of the shaft is connected at a threaded aperture 102 defined in the connector. The brake arm connector is translationally supported in the tube but rotationally fixed. An end 99 of the connector is coupled with the brake arm 66. A friction element or magnetic element may, however, be operably connected directly to the connector. Generally speaking, rotating the knob causes rotation of the shaft 90 to translate the connector within the tube through the interaction between the threaded portion of the shaft and the threaded aperture. Thus, rotating the knob 70 finely pivots the brake arm relative to the flywheel to adjust braking power to whatever braking resistance is desired by the rider.

To rotationally fix the connector 100, the tube defines a pair of opposing slots 104 at an end proximate the brake arm. In one arrangement, the slots run longitudinally along a lower length of the tube, and are positioned with about 180 degrees of separation. The connector includes a pair of keys 106 that fit with the respective slots. Thus, when the shaft 90 is rotated, it drives the actuator within the tube but the interaction between the keys and slots prohibits the rotation of the shaft from rotating the actuator within the tube. More or less slots and keys are possible as are other ways of rotationally fixing the connector, or translationally supporting the connector.

Coarse or "interval" adjustment is achieved by rotating the interval lever 72 to cause the shaft 90 to be moved between a plurality of set positions. In one specific example, the lever can cause the shaft to move between three distinct positions and hence move the brake arm between three distinct positions, such as illustrated in FIGS. 5A-5C. The lever is part of a lever assembly 107 operably coupled with the shaft. To provide for further exercise resistance customization, the interval adjustment acts in concert with fine adjustment. A user first sets the fine resistance for one of the different interval settings, and then the interval resistances are based on the fine adjustment. So, for example, a user may finely adjust resistance, as discussed above, with the interval lever in the upper most interval position, which might be the easiest or recovery resistance. When the user moves the lever to the middle or lower positions, the resistance will be relative to the set recovery resistance, such that when the user returns the lever to the upper position, the resistance will be as finely adjusted. The user can finely adjust any of the different positions.

In one example, the lever assembly includes a tooth collar 108 rotationally supported on the shaft by a pair of opposing bushings 110. The tooth collar defines four equidistantly spaced teeth 112 projecting upwardly from an annular surface 114 of the collar. As discussed further below, the teeth interact with a plurality of detent ramps 116 defined on a detent, or interval, ramp collar 117 to cooperatively drive the shaft and brake arm through the interval positions.

The lever assembly also includes a sleeve 118 of a slightly larger outside diameter than the tube 84. The sleeve moves both rotationally and translationally relative to the tube when the lever is actuated. The sleeve and lever arm are connected to the tooth ring by way of an interconnecting member 120 extending between the collar 108 and the sleeve/lever arm. The sleeve is separated by a gap 122 with the sleeve on the outside of the tube and the collar on the inside of the tube. The interconnecting member extends through a slot 124, in the form of an inverted T, defined from the top of the tube, at the cap, downward.

More specifically, the slot defines a relatively wider section 126 below a relatively narrower section 128. When turning the lever to move between an upper (lower resistance) position through the intervals, the lever handle and interconnecting members moves within the wider lever slot portion between the upper right corner (upper, lower resistance interval), downward and across, to the lower left corner (lowest, greatest resistance interval). The ramps and collar might be reversed such that actuation of the lever moves it from the upper left corner, downward and across to the lower right corner. Regardless, the slot is sized and dimensioned to accommodate the lever through its range of motion both rotationally and translationally relative to the tube.

As introduced above, the respective teeth 112 of the tooth collar 108 interact with a respective plurality of detent ramps 116 defined in the interval ramp collar 117. The interval ramp collar is positioned below the cap 92 and above the lever assembly. The interval ramp collar defines a first bore 119 or aperture through which extends the shaft. The interval collar also defines a second bore 121, larger than the first, that supports a coil spring 123 fixed between the cap and the collar, which takes up any slack in the components within the tube. The interval collar also defines a tab 130 projecting from a side of the collar and received in the upper 128, narrow, portion of the inverted T-slot. The tab prohibits the collar from rotating.

The annular surface of the interval collar facing the tooth collar defines a plurality of interval ramp/detent structures 116. In the implementation shown, there are four interval ramp/detent structures corresponding to the four teeth 112, and the four interval structures are equidistantly spaced like the teeth such that a respective tooth engages a respective interval structure. Each ramp/detent structure provides three detent or "interval" locations. As shown, an interval structure defines a first—or, upper—detent 132A defined on the collar surface from which project the ramp/detent structures. Each ramp/detent structure defines a first ramp 134A and a second ramp 134B with the first, a second (or "mid") 132B, and a third—or, lower—detent 132C separated by the first ramp and the second ramp.

Referring to the tooth collar, a tooth has a long face 136A intersecting a short face 136B to define a point 138. With the points engaging the upper detents 132A, the long face 136A of each tooth abuts the first (upper) ramp. In this position, the brake arm is in its upper interval position (lowest braking resistance of the three interval resistances). Further, in this position, the interval lever and interconnecting member are positioned at the upper right corner of the larger width portion of the inverted T-slot.

When a user rotates the lever clockwise (to the left), the long face 136A of a tooth, abutting an upper ramp 134A, drives the tooth collar portion of the lever and the interconnected shaft downward until the points 138 of the teeth set in the respective mid-detents 132B. Thus, the brake arm 66 moves relative to the flywheel from a first position (e.g. as shown in FIG. 5A), associated with the upper detent, to a second position (with greater resistance than the first position) associated with the mid-detent (e.g., as shown in FIG. 5B). The travel distance of the brake arm is set by the distance between the upper detent and the mid-detent (distance D1). From the mid-detent, a user may rotate the lever clockwise (to the lower detent) or counterclockwise back to the upper detent. If clockwise, the long faces of the teeth are abutting the respective lower ramps 134B. Rotating the lever pushes the tooth face against the ramp, pushing the lever arm assembly and the attached shaft downward so that the brake arm moves relative to the flywheel to a third position (with greater resistance than the second position). The travel distance of the brake arm is set by the distance between the mid-detent and the lower detent (distance D2). Due to the return or upward force on the brake arm due to the torsion spring 78, the interaction of the teeth and detent notches act as detents due to the retention of the teeth in a detent caused by the spring force. Also as discussed in more detail herein, should the user depress the knob to effect an immediate braking action, the torsion spring force on the brake arm returns the shaft and other components to the normal position (fully upward), after the user stops pushing on the brake knob. The interaction of the teeth and the detent recesses also arrests the rotation of the lever between positions and provide a discernible feeling on the lever when the teeth snap into the recesses.

Depending on the number of teeth and detent ramps, the size of the tube and interval ramp collar, the shape of the ramps, and other factors, the number and distance between distinct positions may be more or less than three, and the distance difference between positions may not be same. For example, the tooth collar may have two teeth, 180 degrees separated, and there may be only two relatively larger ramp structures on the interval ramp with two detents between an upper and lower detents, and separated by an additional ramp providing four interval positions. Other similar variations are possible.

Besides the brake adjustment assembly allowing a rider to adjust the brake force by finely pivoting the brake arm to position the magnets relative to the flywheel or by using the interval lever to coarsely adjust the brake force, the brake adjustment assembly also allows a rider to stop the flywheel by forcing a brake pad 83, transverse between the magnet in the upper part of the housing 80, down on flywheel 56. At an upper end of the tube, distal the brake arm, the brake adjustment assembly includes the brake knob 70 fixed to the shaft 90. The brake knob includes or otherwise defines the cavity 86 suitable to receive the top of the tube and for the knob to fit over the tube and any components associated therewith.

To rapidly stop the flywheel, a rider may press downward on the handle which moves the shaft 90 downward within the tube. The cavity 86 of the knob is pressed downward over the tube 84. Further, the shaft, through engagement with the brake arm, pivots the brake arm 66 downward such that the brake pad 83 contacts the flywheel. When the rider releases the knob or reduces the force on the knob, the spring 78 acting on the brake arm, pushes the shaft and knob upward to disengage the pad and release the flywheel.

FIGS. 21-27 illustrate another implementation of a brake arm adjustment assembly according to the present disclosure, and, more specifically, a brake actuator 400 of a brake arm adjustment assembly and components thereof according to the present disclosure. Similar to the brake actuator 64 discussed in the context of FIGS. 1-13, the brake actuator 400 is adapted to be incorporated into an exercise machine, such as an indoor cycle, to facilitate adjustment of braking resistance of a wheel.

Figure 7:
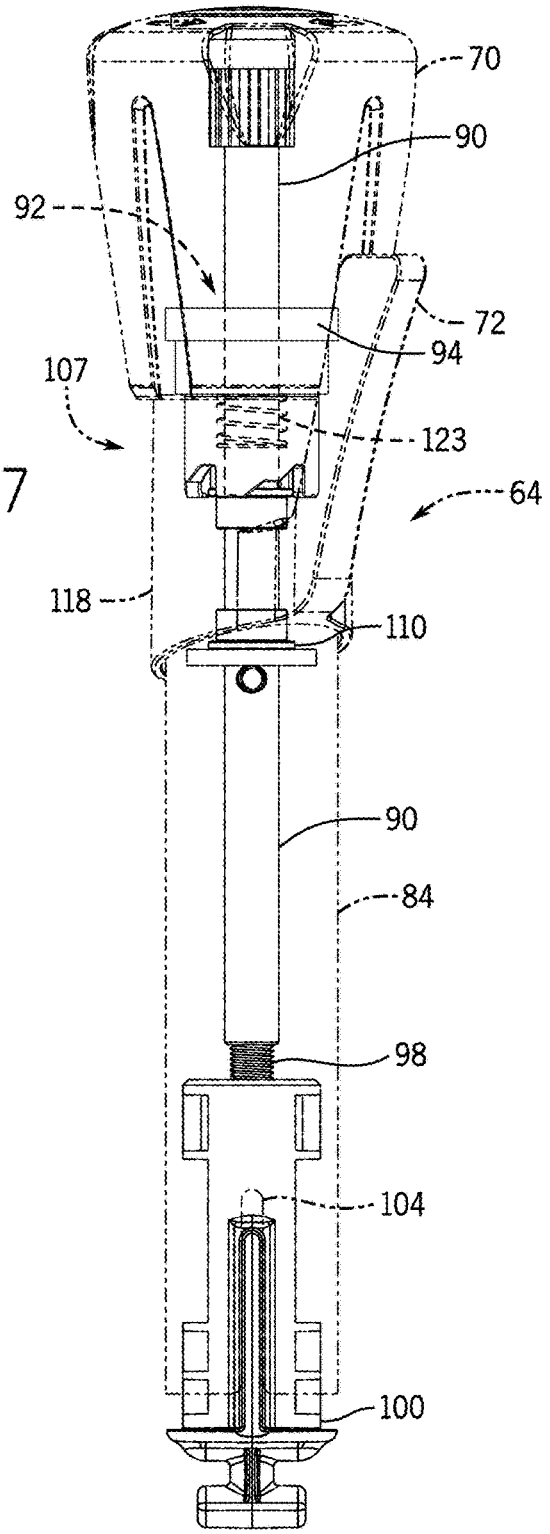
FIG. 7 is a view of the multifunction brake actuator.
Figure 8:
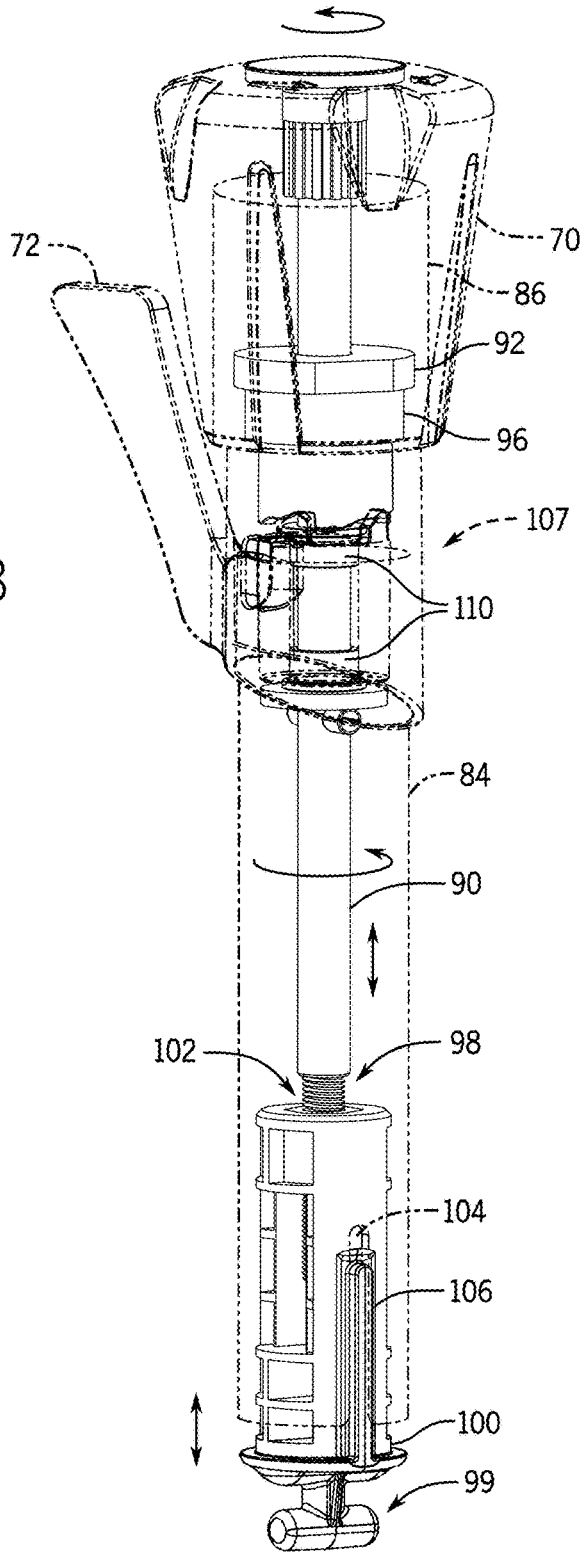
FIG. 8 is an alternative view of the multifunction brake actuator.
Figure 9:
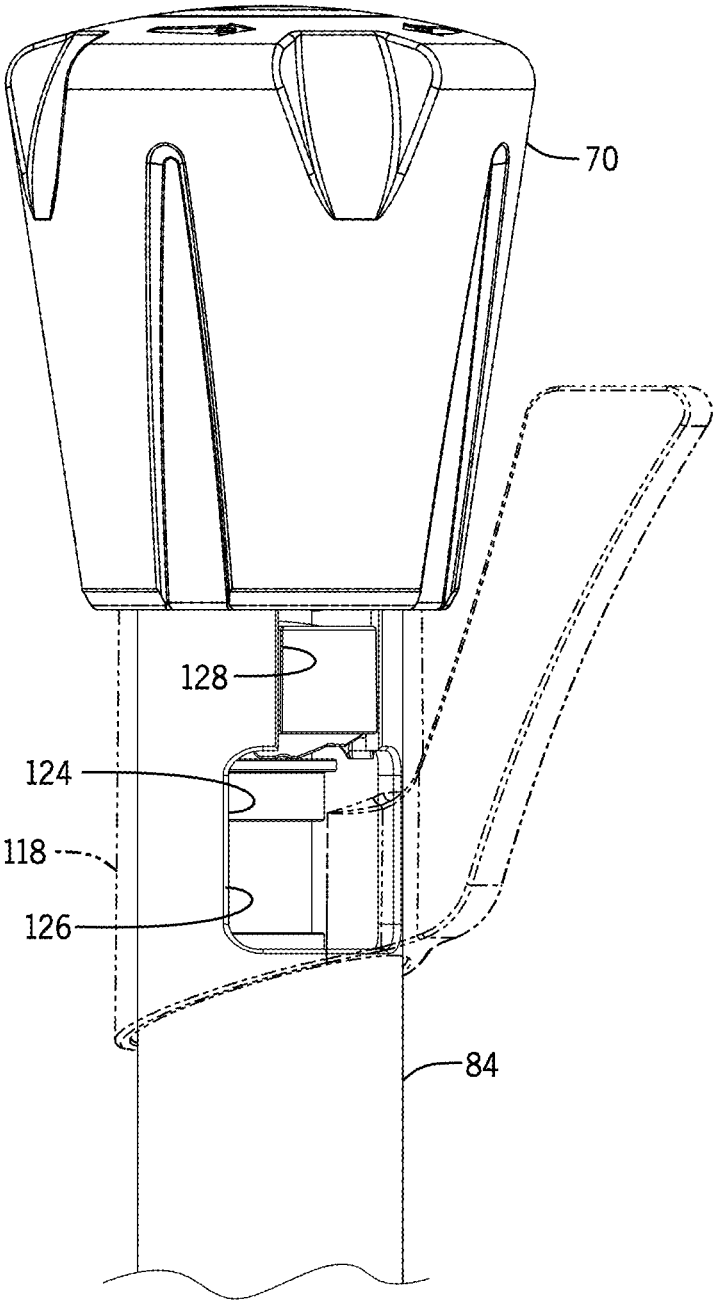
FIG. 9 is a close up view of a top portion of the multifunction brake actuator and related components.
Figure 10:
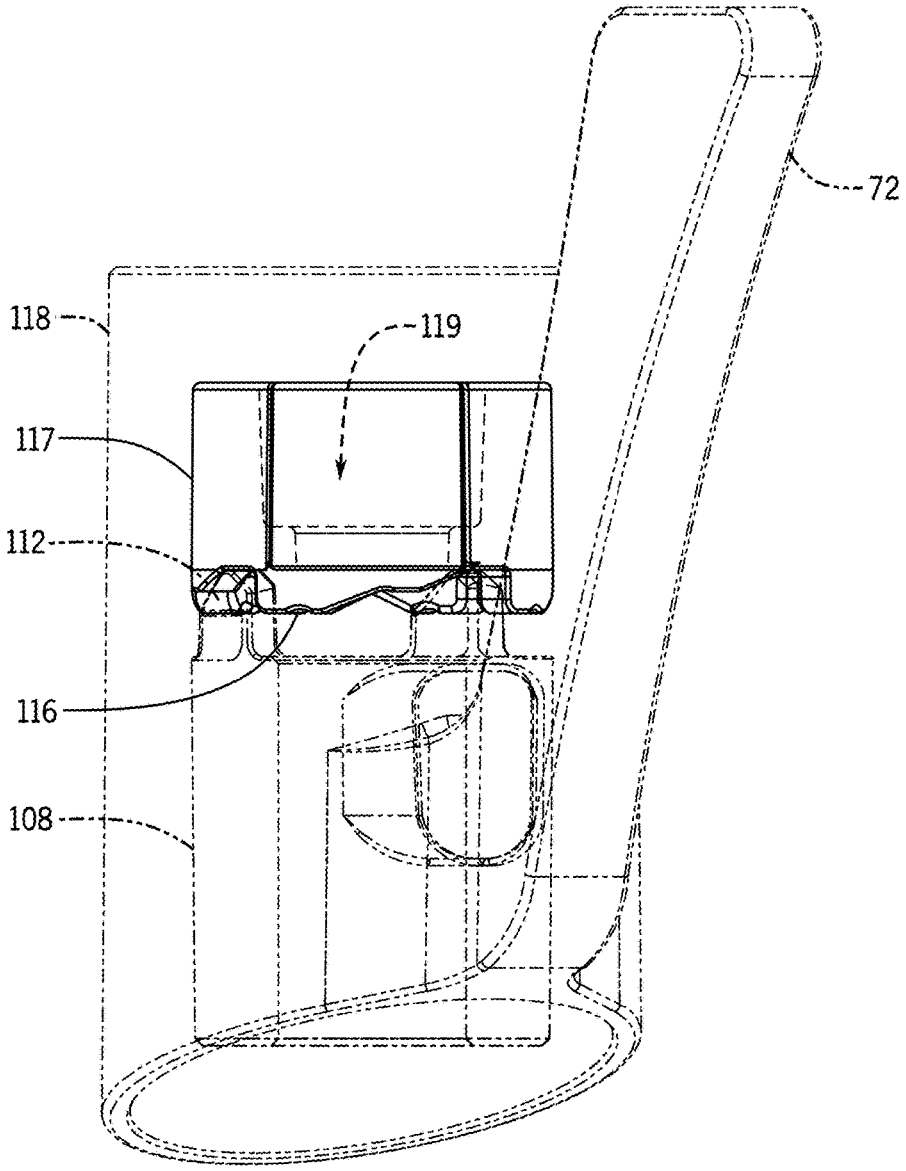
FIG. 10 is a view of a lever assembly and detent collar.
Figure 11:
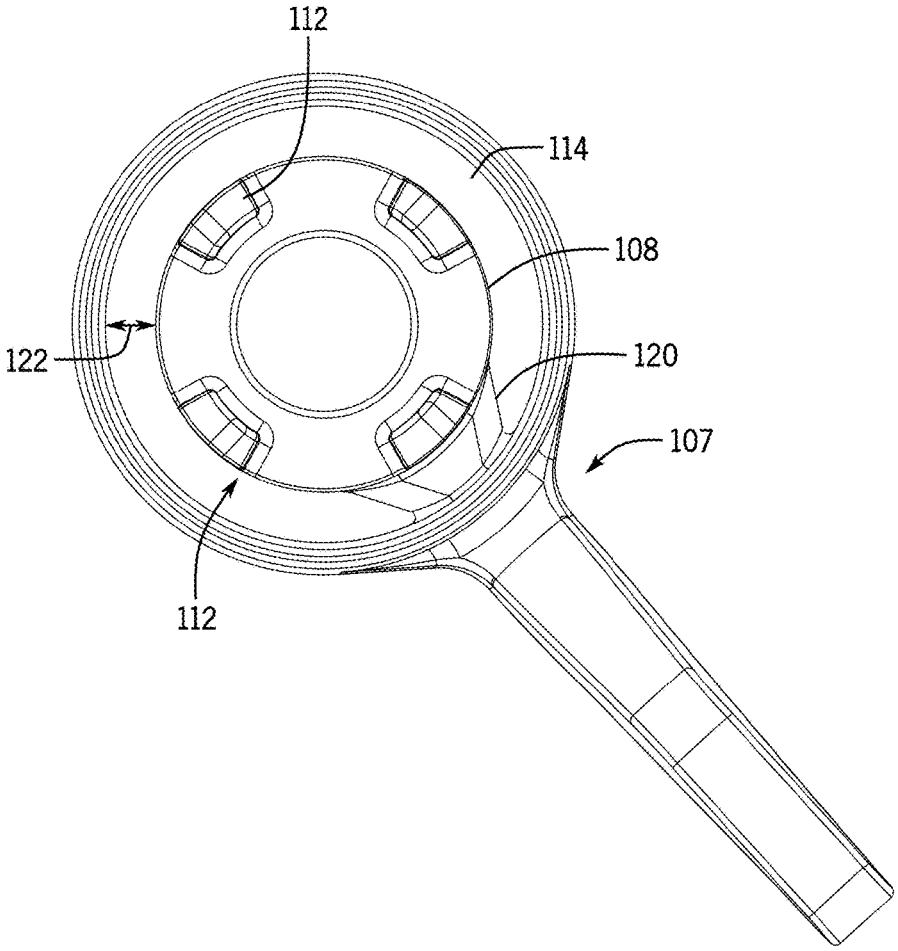
FIG. 11 is a top view of the lever assembly.
Figure 12:
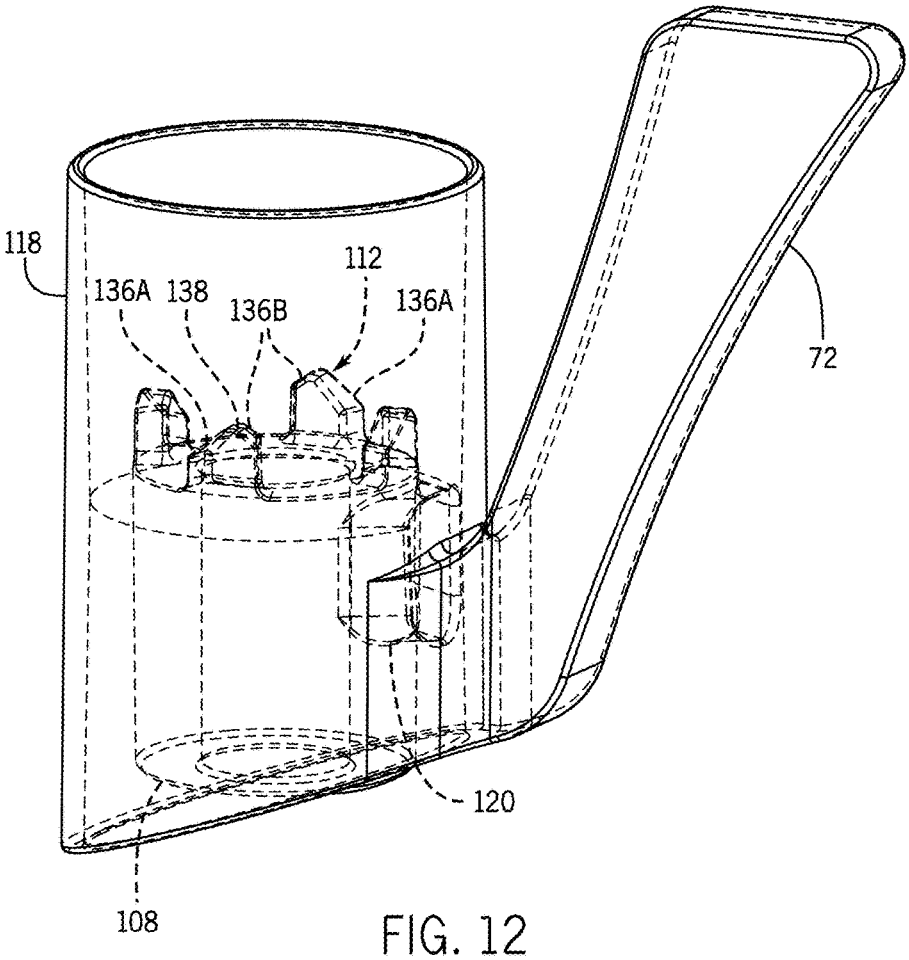
FIG. 12 is an isometric view of the lever assembly.
Figure 13:
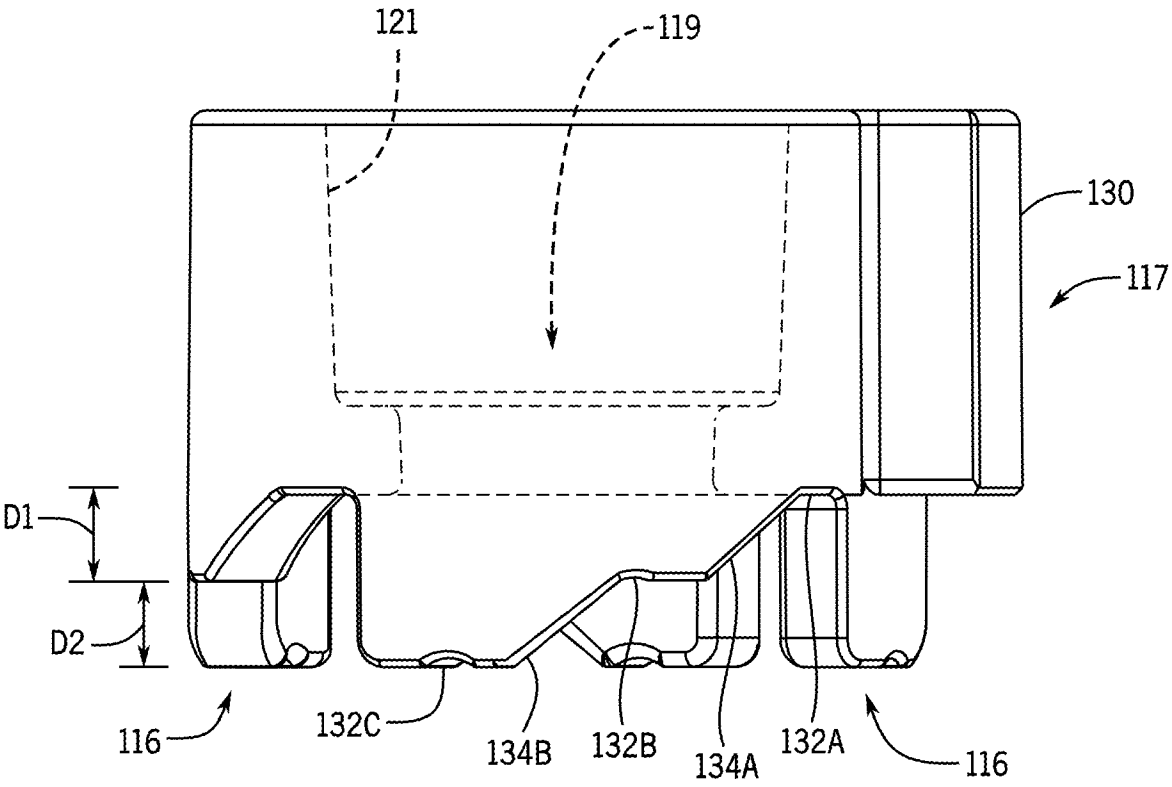
FIG. 13 is a side view of the detent collar.

As previously discussed, the brake actuator 64 of FIGS. 7-9 includes a lever assembly 107 that further includes a tooth collar 108 rotationally supported on a shaft 90 by a pair of opposing bushings 110. As illustrated in FIG. 8, for example, the opposing bushings 110 abut and extend into a bore extending through the tooth collar 108. In certain cases, contact between the opposing bushings 110 and the tooth collar 108 may cause frictional engagement between the tooth collar 108 and the opposing bushings 110 such that forces applied to the shaft 90 may be transmitted to the tooth collar 108 and vice versa. Such friction may, for example, be the result of dirt, sweat, or similar build-up within the tube 84 and, in particular, between the opposing bushings 110 and the tooth collar 108. As a result of such friction, rotation of the shaft 90, such as by rotation of the knob 70, may result in inadvertent rotation of the lever assembly 107. Similarly, the frictional engagement may also cause inadvertent rotation of the shaft 90 when the lever assembly 107 is shifted between positions. In either case, the inadvertent rotation of either component results in drift or changes in the position of the shaft 90 relative and, consequently, the brake arm 66. Because the brake force provided by the brake arm 66 is dependent on its relative position to the wheel 56 of the exercise equipment, such drifting of the brake arm 66 may result in unintended changes in the resistance provided by the brake arm 66.

To address the foregoing issue, the brake actuator 400 of FIGS. 21-27 includes a spacer 450 disposed between a lever assembly 407 and the shaft 90 such that a tooth collar 408 of the lever assembly 407 does not directly engage the shaft 90. As discussed below in more detail, the lever assembly 407 is freely rotatable about the spacer 450, which in turn may be rotationally interlocked to a ramp collar 417. Like the ramp collar 117 of the brake actuator 64, the ramp collar 417 includes various teeth that interact with the tooth collar 408 of the lever assembly 407 to facilitate coarse shifting of the shaft 90 and corresponding coarse changes to the resistance provided by the brake arm 66.

Figure 21:
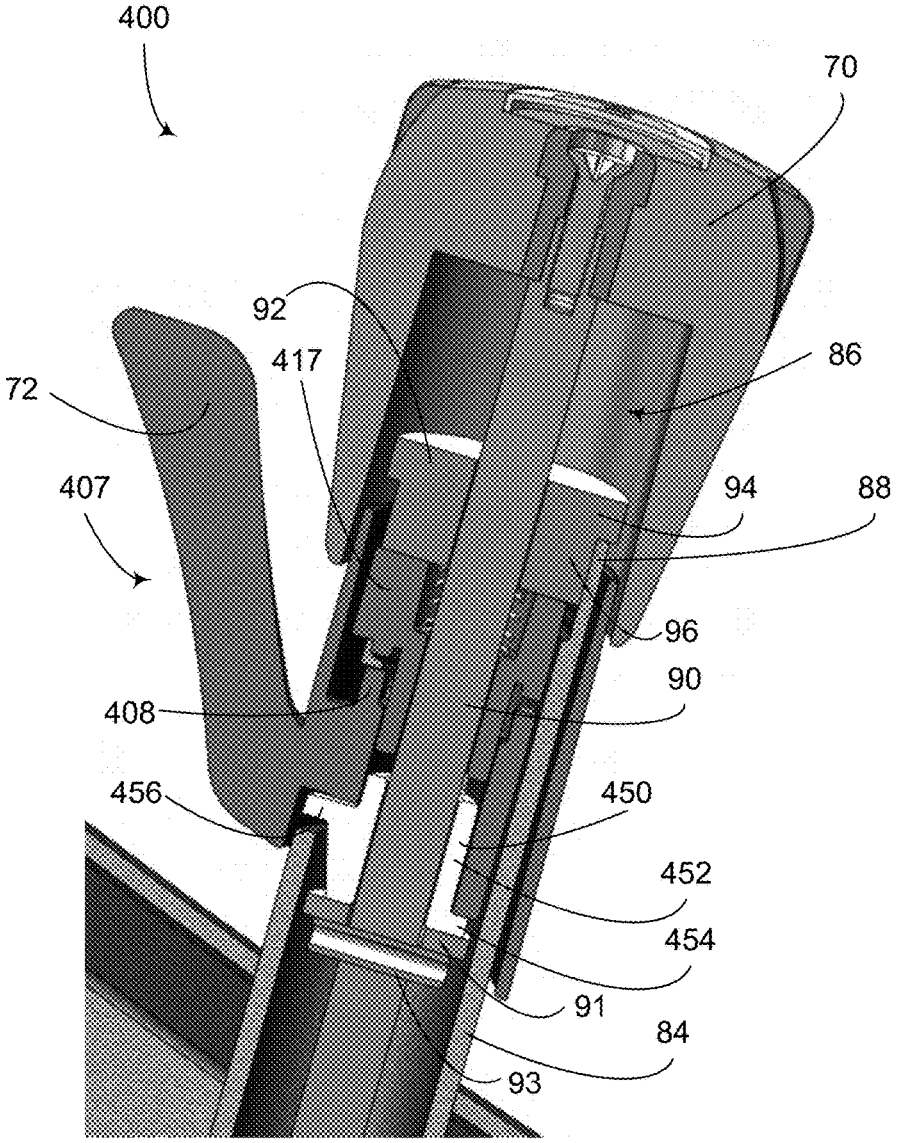
FIG. 21 is a cross-sectional view of an alternative lever assembly.
Figure 22:
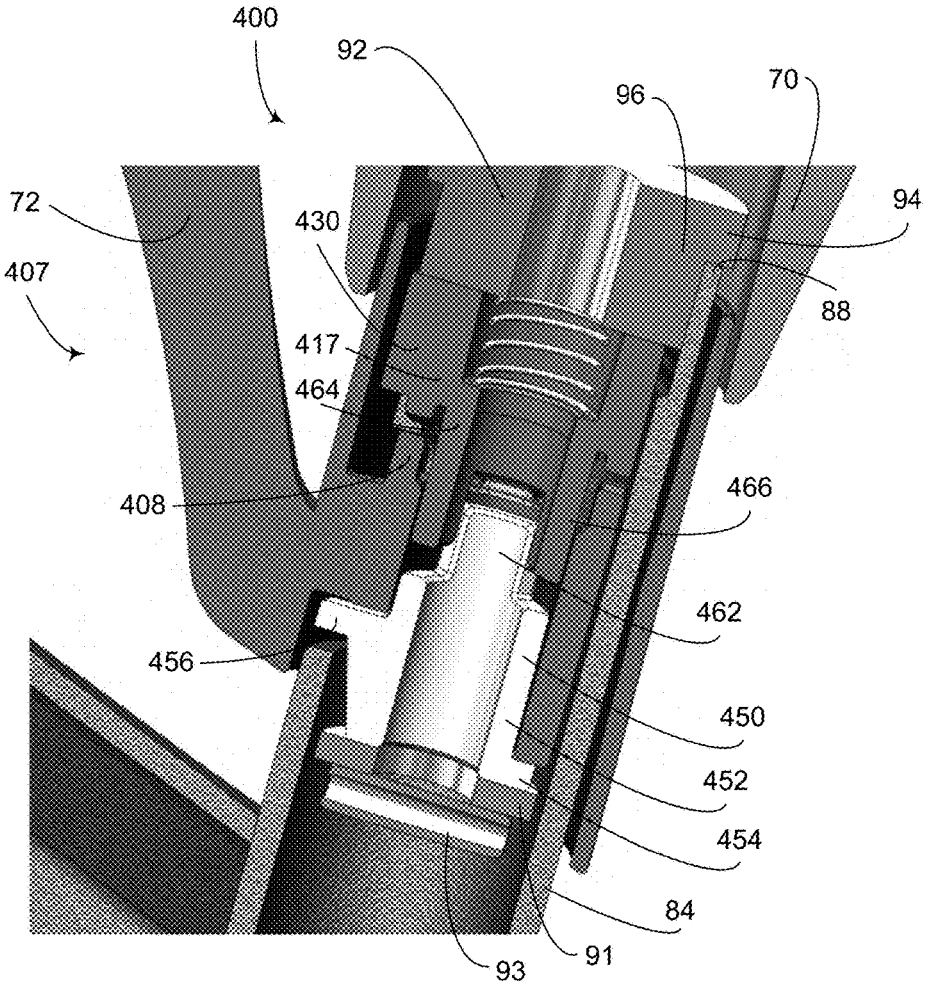
FIG. 22 is a detailed view of the lever assembly of FIG. 21 with a shaft removed.
Figure 23:
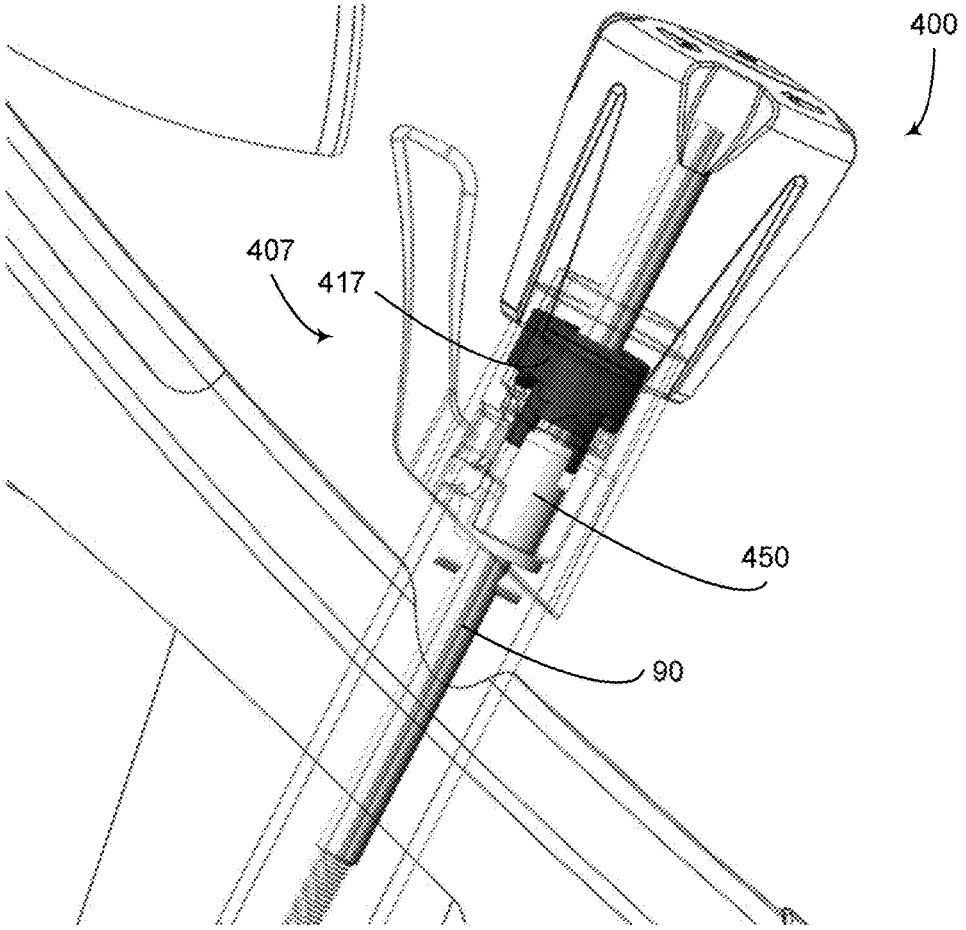
FIG. 23 is an isometric view of the lever assembly of FIG. 21 with certain elements illustrated in transparency to show the arrangement of internal components of the lever assembly.

FIG. 21 is a cross-sectional view of the brake actuator 400, FIG. 22 is a cross-sectional side detail view of the brake actuator 400 with the shaft 90 removed for clarity, and FIG. 23 is an isometric view of the brake actuator 400 with various components shown in transparency to further illustrate the assembly of the brake actuator 400. With the exception of the components and features identified and described in the following discussion, other components coupled to the brake actuator 400 and their general functionality are substantially similar to those of the exercise bicycle 10 discussed in the context of FIGS. 1-6. So, for example, brake actuator 400 is coupled to a shaft 90, as illustrated in FIG. 21, which in turn is coupled to a brake arm 66 in order to facilitate both fine and coarse adjustments of the brake arm 66, as illustrated in FIGS. 4A-5C.

The brake actuator 400 includes a tube 84 fixed to the down (or top) tube 32 of the exercise bicycle 10 (shown in FIG. 1). Many of the functional components of the brake actuator 400 are supported in, or relative to, the tube 84. The brake actuator 400 includes a knob 70 coupled with a shaft 90 extending through the tube 84. The knob 70 defines a cavity 86 that fits over a top portion 88 of the support tube 84. Proximate the knob 70, the shaft 90 extends through a bore (or aperture) defined in a cap 92 pressed into the top of the tube. The cap 92 defines a top collar 94 above the tube 84 that retains the cap 92 at the top of the tube 84. The cap 92 also defines an extension 96 that extends within the tube and is about the same inside diameter of the tube 84.

The brake actuator 400 includes each of an interval or ramp collar 417, a spacer 450, and a lever assembly 407 that further includes a tooth collar 408. During operation, the shaft 90 may be finely translated by rotation of the knob 70 which causes the shaft 90 to advance or retract relative to the brake arm connector 100 via a threaded connection with the brake arm connector 100. Coarse or "interval" adjustment is achieved by rotation of an interval lever 72 of the lever assembly 407, which causes teeth of the tooth collar 408 to selectively engage ramp/detent structures 416 (shown in FIGS. 26-27) of the ramp collar 417 in a manner substantially similar to that describe previously in the context of the brake actuator 64. The ramp/detent structures 416 are more clearly illustrated in FIGS. 26-27, which are isometric and side views of the tooth collar 408.

Figure 24:
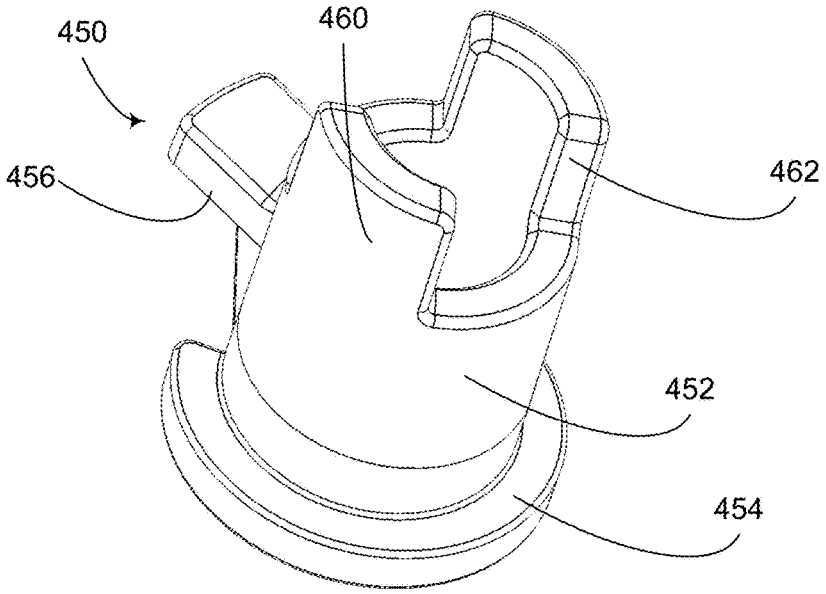
FIGS. 24-25 are an isometric and side view, respectively of a spacer of the lever assembly of FIG. 21.
Figure 25:
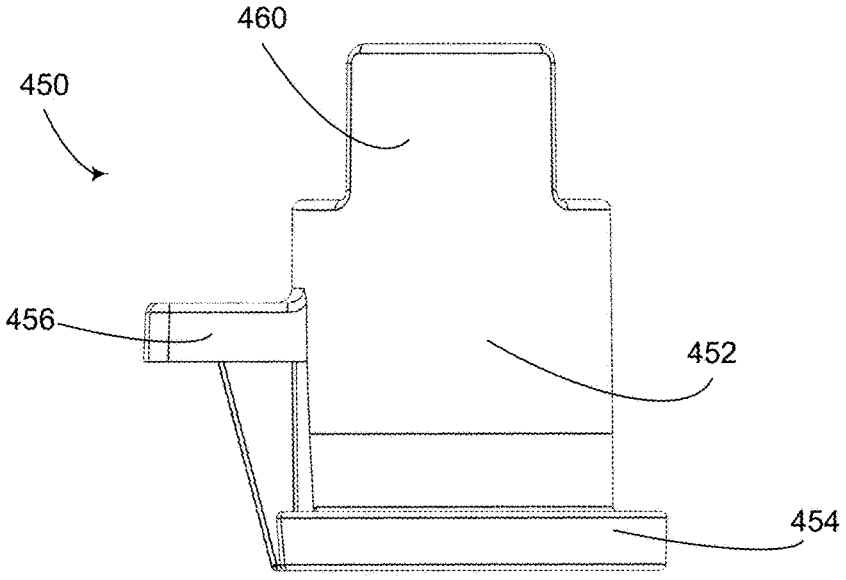

The lever assembly 407 is isolated from direct contact with the shaft 90 by the spacer 450 (shown in further detail in FIGS. 24-25, which are isometric and side views of the spacer 450, respectively). The spacer 450 includes a cylindrical body 452 and is supported by a lateral support 91 on the shaft 90. As illustrated in FIGS. 21-22, the lateral support 91 may be a washer or similar element through which the shaft 90 extends. The lateral support 91 may be secured in position on the shaft 90 by a pin 93 or similar supporting element coupled to the shaft 90. In other implementations, the lateral support 91 may be directly coupled to the shaft 90, such as by welding or an adhesive, thereby eliminating the need for the pin 93. The pin 93 may also be directly coupled to the shaft 90 or may be maintained in place by a press or interference fit. The spacer 450 further includes one or more flanges, such as flange 454, and/or tabs, such as tab 456, extending from the cylindrical body 452, each of which include proximal surfaces that abut corresponding distal surfaces of the lever assembly 407.

During operation, the ramp collar 417 is maintained in a fixed position. As the lever assembly 407 is rotated, the tooth collar 408 of the lever assembly 407 interacts with the ramp/detent structures 416 of the ramp collar 417 to vary the longitudinal displacement of the lever assembly 407 relative to the support tube 48. As the lever assembly 407 translates, a corresponding longitudinal force is applied to the shaft 90 via the lateral support 91 and the pin 93 such that the shaft 90 translates with the lever assembly 407. More specifically, as the lever assembly 407 is rotated and the lever assembly 407 is translated by interaction of the tooth collar 408 with the ramp collar 417, the spacer 450 is similarly translated due to the contact between the lever assembly 407 and the flanges 454 or tabs 456 of the spacer 450. Translation of the spacer 450 in turn causes translation of the shaft 90 due to contact between the spacer 450 and the lateral support flange 91, resulting in coarse resistance adjustment due to the coupling of the shaft 90 to the brake arm 66.

Figure 26:
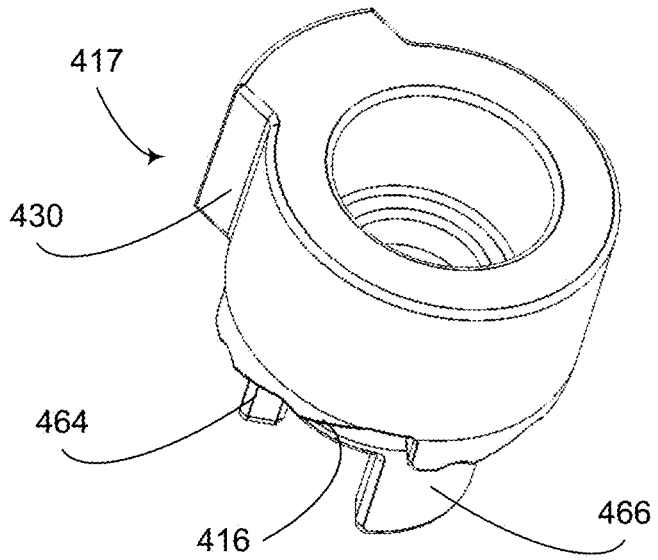
FIGS. 26-27 are an isometric view and a side view of a ramp/interval collar of the lever assembly of FIG. 21.
Figure 27:
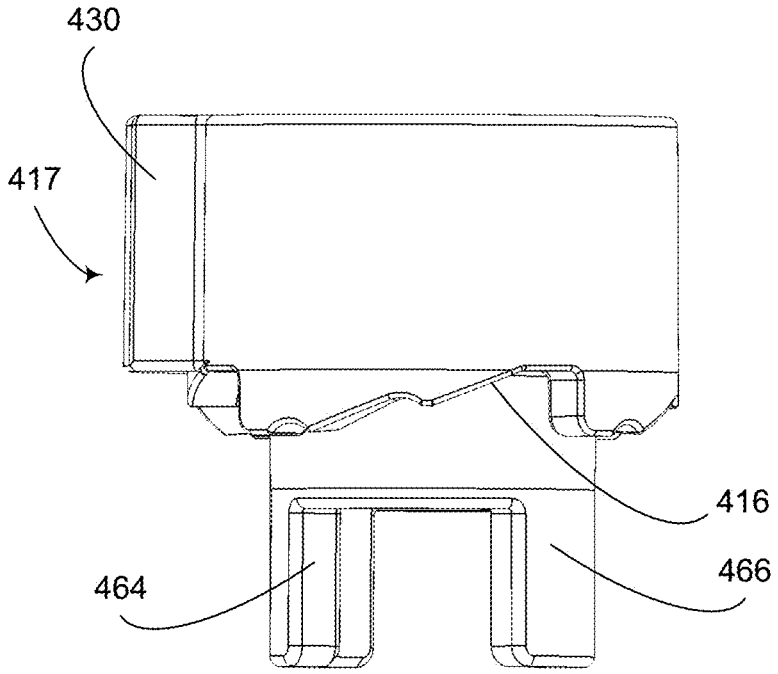

In certain implementations, each of the spacer 450 and the ramp collar 417 may be rotationally locked relative to one or more of the tube 84 or each other. For example, as shown in FIGS. 26-27, the ramp collar 417 may include a tab 430 or similar projection extending radially from the ramp collar 417 and shaped to be received by a corresponding slot of the tube 84. For example, the tab 430 may be shaped to be received in the upper 128, narrow, portion of the inverted T-slot 124 (shown, for example, in FIG. 9). Similarly, the tab 456 of the spacer 420 may be shaped to extend through the wider section 126 of the T-slot 124 such that rotation of the spacer 420 is limited by the walls of the wider section 126.

Rotation of the spacer 450 and the ramp collar 417 may further be limited by interlocking the spacer 450 and the ramp collar 417 to each other. For example, in certain implementations, the ramp collar 417 may be rotationally fixed relative to the tube 84 and may then interlock with the spacer 450 such that rotation of the spacer 450 is also prevented. Alternatively, the spacer 450 may be rotationally fixed relative to the tube 84 and the ramp collar 417 may be rotationally fixed by interlocking with the spacer 450.

The arrangement of the lever assembly 407, the spacer 450, and the ramp collar 417 illustrated in FIGS. 21-23 eliminates contact between the lever assembly 407 and the shaft 90 and prevents inadvertent rotation of the lever assembly 407 when the shaft 90 is rotated and vice versa. Specifically, the spacer 450 eliminates direct contact and corresponding friction between the lever assembly 407 and the shaft 90. Although friction may occur between the lever assembly 407 and the spacer 450 or the spacer 450 and the shaft 90 as the lever assembly 407 and the shaft 90 are rotated, respectively, any torque resulting from such friction is not transferred between the lever assembly 407 and the shaft 90 due to spacer 450 being rotationally locked (such as by coupling to the tube 48 or by interlocking with the rotationally fixed ramp collar 417). As a result, inadvertent rotation of the shaft 90 by rotation of the lever assembly 407 and vice versa is eliminated.

In one implementation, the spacer 450 may include one or more spacer bosses 460,462 shaped to mate with corresponding collar bosses 464,466 of the ramp collar 417. The spacer bosses 460,462 are illustrated in FIGS. 24-25 as curved rectangular protrusions extending longitudinally from the cylindrical body 452 of the spacer 450. Similarly, the collar bosses 464, 466 are illustrated in FIGS. 26-27 as longitudinally extending and curved rectangular protrusions. As shown in FIG. 22, when assembled within the tube 84, the spacer bosses 460, 462 are interdigitated with the collar bosses 464, 466 such that the spacer 450 and ramp collar 417 are rotationally interlocked. Notably, interlocking of the spacer 450 with the ramp collar 417 does not prevent translation of the spacer 450 relative to the ramp collar 417, which facilitates coarse adjustment of the shaft 90. More specifically, the spacer bosses 460, 462 and the collar bosses 464, 466 are substantially long enough that the spacer 450 remains interlocked with the ramp collar 417 as the lever assembly 407 is rotated between interval positions. Such rotation of the lever assembly 407 causes the lever assembly 407 and the spacer 450 to translate relative to the ramp collar 417, potentially increasing the distance between the spacer 450 and the ramp collar 417. By sufficiently elongating the spacer bosses 460, 462 and the collar bosses 464, 466, the spacer 450 and the ramp collar 417 remain interlocked across the full range of lever assembly positions.

The pairs of spacer bosses 460, 462 and collar bosses 464, 466 illustrated are merely one example of interlocking features that may be used in implementations of the present disclosure. Any number or arrangement of bosses may be used provided they sufficiently interlock the spacer 450 and the ramp collar 417 to prevent relative rotation therebetween. The curved rectangular bosses illustrated are also intended only as examples of possible interlocking features that may be implemented. In other implementations, for example, the spacer 450 and the ramp collar 417 may include, among other things, mating dovetails, mating tongue-and-groove structures, or any other suitable joint that prevents relative rotation while allowing for relative translation between the spacer 450 and the ramp collar 417.

Pop-Pin

Aspects of the present disclosure further involve a pop-pin 26 that may be finely adjusted and then actuated to engage or disengage through use of a lever. When adjusted and engaged, the pop-pin secures a pin 202 into a mating hole but also does so tightly. In comparison to conventional pins that require multiple steps to loosen, disengage, adjust, engage and tighten; the present pop-pin allows a user to disengage, adjust and engage (or vice versa)—effectively eliminating two actions. Thus, there are fewer steps involved in adjusting the seat height or handlebar height when used on an exercise bicycle. Moreover, the loosening and tightening steps that are eliminated, allow the user to make quick and easy adjustments that are simply not possible through conventional arrangements. Further, the clamping force tightly locks the members in a way not possible or which would substantially greater effort than in conventional designs.

More particularly, the pop-pin, which may also be referred to herein as a pop-pin assembly, is coupled to a first tube (e.g. seat tube 22 or head tube 34) at a pin tube 204. The pop-pin is also a form of an over-center clamp. The pin tube extends from and is coupled to the first tube. The first tube houses a second tube (e.g. the seat post 24 or the handle bar post 50) defining a plurality of holes 206. In one possible example, the first tube is the seat tube and the second tube is the seat stem. Generally speaking, when the pin 202 is engaged with one of the plurality of holes 206, the first tube is fixed relative to the second tube (while referenced as "tubes," it should be recognized that other members, besides tube style structures may be used). When the pin is withdrawn from the hole, the second (inner) tube may be adjusted relative to the first (outer) tube (e.g. to raise or lower the seat 18 or the handlebars 20).

As shown, the pin tube 204 is fixed in a corresponding opening in the first tube. The pin tube defines a pin aperture 208, which is a channel through which the pin 202 traverses between an engaged (clamped) position and a disengaged (release) position. The pin tube includes a flange 210 to which a pivot bracket and housing 212 is mounted. The housing supports many of the functional components of the pop-pin. The housing may further include a cover 213, within which are many of the various functional components of the assembly.

The pin includes a collar 214 defining a bore 217. As shown, the pin portion 202 extends into one of the apertures 206 in the tube fixing the relative movement between the tubes. It should be noted that the pop-pin assembly, or more generally engagement assembly, is discussed with respect to a pin that engages an aperture. It is possible, however, that the shaft may support some other form of structure such as a flat face or a roughened face that presses on the inner tube to form a resistance fit, or presses on and depresses a ball detent or other structure in the tube. Hence, the shaft creates the engagement between the tubes, and the description of a pin is but one way. Nonetheless, referring again to the pin, an outward face 219 of the collar 214 abuts the tube circumferentially around the pinned aperture 206A. As will be discussed in more detail below, when the pop-pin is engaged, the outward face of the pin collar presses on the tube, and depending on the arrangement, will tightly couple the first tube to the second tube by pressing the second tube (e.g., seat post or handlebar stem) against the wall opposing the wall to which the pin tube is attached thereby tightening the tubes to reduce or eliminate any sloppiness or looseness between the tubes.

An adjustment shaft 216 is connected to the pin at the bore 217. In one example, the adjustment shaft is connected to the pin with a retaining pin 218 that extends through an aperture in the pin collar and an aligned aperture in the adjustment shaft. Alternatively, one or a pair of spring-loaded ball detents may be defined in the adjustment shaft whereby the ball portion couples the adjustment shaft to the apertures in the pin collar. In yet another alternative, a retaining pin may be threaded and engage a corresponding threaded bore in the adjustment shaft. Regardless of the mechanism, however, the threaded shaft is coupled with the pin.

Distal the pin, an adjustment knob 220 is coupled with the shaft 216. Between the knob and the pin, the adjustment shaft defines a threaded portion 222 that engages a corresponding threaded bore 224 defined in a drive shaft 226. The adjustment shaft is translationally and rotatably supported in a smooth bore portion 228 of the drive shaft. By rotating the knob, the adjustment shaft rotates and through the interaction between the treads and threaded bore, finely adjusts the position of the adjustment shaft and pin relative to the drive shaft 226.

The drive shaft 226 is translationally supported in a guide passage 230 defined or otherwise provided in the housing. The clamp lever 200 is coupled to the drive shaft at a cam roller 232. In one example, the cam roller extends from the drive shaft, through a slot 234 in the guide passage, and is supported in a cam slot 236 defined in or otherwise provided with the clamp lever. In the particular implementation shown, the drive shaft includes a pair of cam rollers (232A, 232B) extending from opposing sides of the drive shaft, and through opposing slots (234A, 234B) in the guide passage. Similarly, the clamp lever defines opposing cam slots (236A, 236B) defined in opposing ears (238A, 238B) extending from a handle portion of the lever. The lever is pivotally coupled with the housing at a pivot axle 240. Generally speaking, pivoting of the lever causes the cam slot to extend the drive shaft to engage the pin or to retract the drive shaft to disengage the pin from a hole 206.

Referring again to the adjustment shaft, a first spring 242, which may be a coil spring, is positioned between the tolerance adjustment knob 220 and the drive shaft. The first spring provides a force between the drive shaft and the knob to put pressure on the knob to hold it in place. The knob 220 includes a collar 244 that traps the adjustment knob and the attached adjustment shaft in the guide passage 230.

At an end of the drive shaft 226 proximate the pin collar 214, a second spring 246 is positioned between a spring collar 248 of the drive shaft and the housing 212. More specifically, the housing includes a countersunk hole 250, which may be a bore, formed, molded, etc., depending on the structure of the housing, sufficient to receive the collar 248 and a portion of the pin tube 204 extending from flange 210. The guide passage, defined in one example as a cylinder smaller than the countersunk hole, is within the countersunk hole. The second spring may be a coil spring surrounding the guide shaft, and abutting the wall of the hole surrounding the guide passage. The second spring forces the pin into the hole by driving the drive shaft outward. This ensures that the pin engages firmly even if the lever is not fully clamped (pushed inward toward the tubes).

Referring now to operation of the device and fine adjustment, rotating the adjustment shaft changes the position of the pin 202 relative to the drive shaft 226 thereby finely adjusting the amount of coupling force the pin collar places between the tubes. Typically, a stem (or second tube) fits within a tube (or first tube) with some amount of space between the wall (in the case of circular tubes) or walls (in the case of rectangular, trapezoidal or square tubes). Thus, even if pinned, the stem may be loose within the seat tube unless one or more walls of the tubes are pressed together to frictionally couple the tubes. In the case of the tubes illustrated herein, the pin collar 214 presses the stem (e.g. stem 24) rearward so that a rear wall of the stem abuts a rear wall of the tube (e.g. seat tube 22). Since the spacing between tubes may vary and the dimensions may vary, having a fixed translational movement of the drive shaft would not cause the correct amount of inter tube coupling unless the space was precisely matched to the gaps. To alleviate this concern, the pop-pin 26 is provided with a fine adjustment to change the pin position relative to the drive shaft. Retracting the adjustment shaft compensates for a relative smaller gap between tubes and extending the adjustment shaft compensates for a relatively larger gap between the tubes. So, for example, if rotating the lever moves the drive shaft a fixed distance from a retracted position to an extended position, and the stem is loose relative to the seat tube, then the user can retract the pin, turn the adjustment knob to extend the pin relative to the guide shaft until a tight coupling between the stem and tube is achieved. Conversely, if the user cannot rotate the lever fully to engage the pin, then the user can rotate the knob to retract the pin relative to the guide shaft until a tight coupling between the stem and tube is achieved. Once the pin is properly adjusted, further adjustments should not be required. An O-ring 252, or other compliant (flexible or resilient) material or structure may also be included around the pin at the collar to help seat the pin against the tube.

Actuating the properly adjusted pin, involves pivoting the clamp lever. The cam slots each define an asymmetric curved slot 236 with a first end 254 and a second end 256. The first, upper, end defines a fully withdrawn position of the drive shaft. The second, lower, end defines a fully extended position of the drive shaft. Since the cam roller 232 is trapped in the slot, rotating the lever and the cam slot cause the cam roller and drive shaft to move between the fully extended and withdrawn positions.

Figure 14:
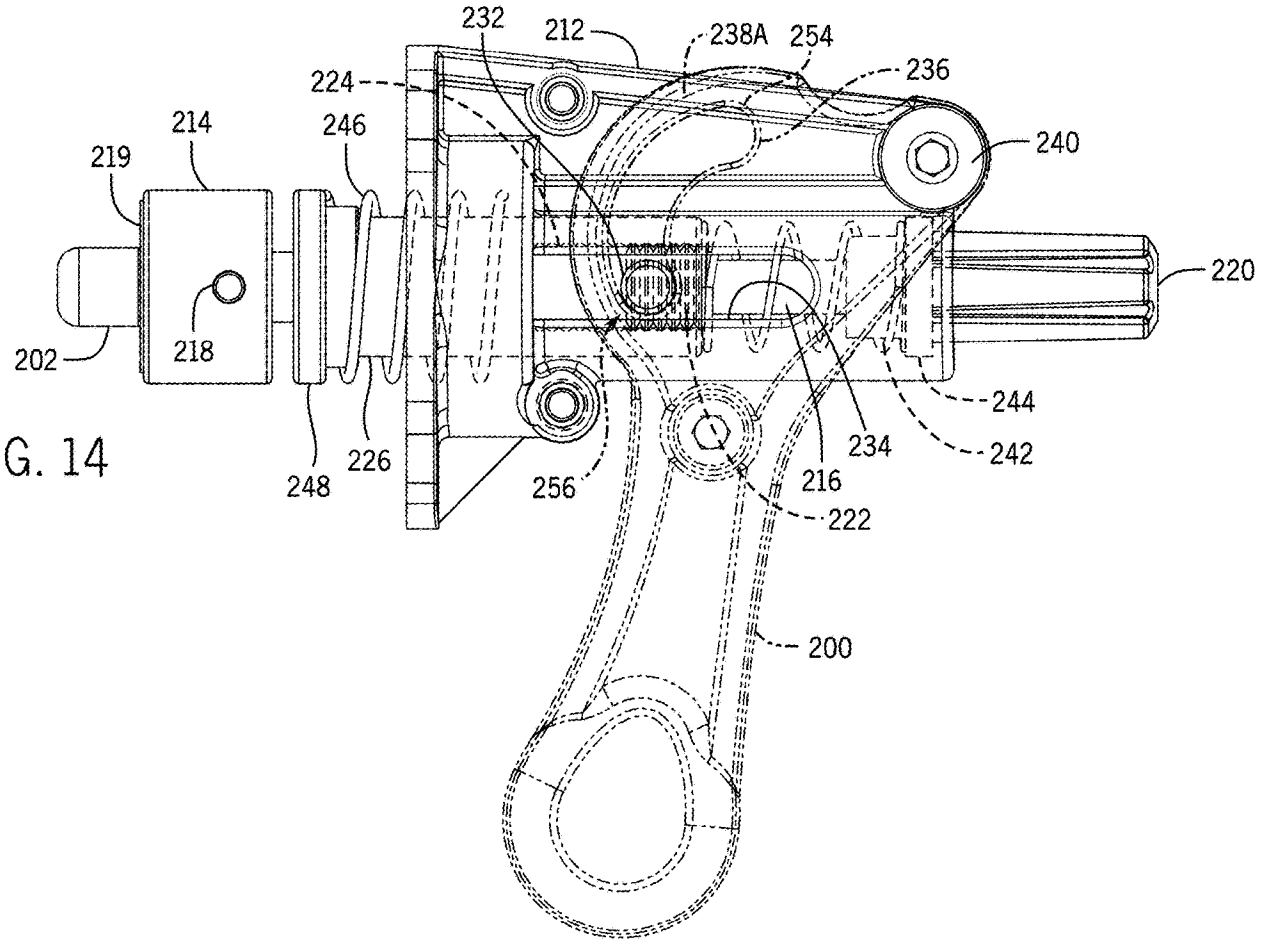
FIG. 14 is a side view of a pin assembly.
Figure 18B:
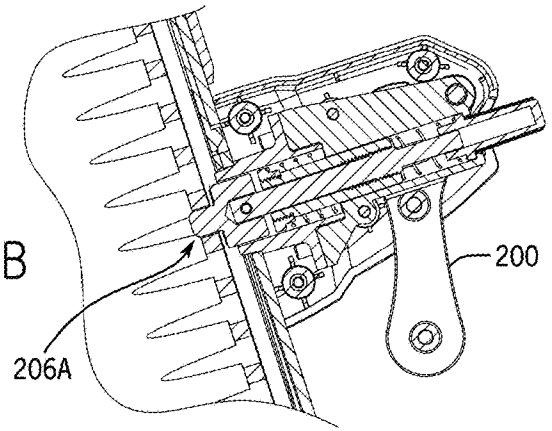
FIGS. 18A-18C are view of the pin assembly in a neutral, clamped, and released position, respectively.
Figure 19:
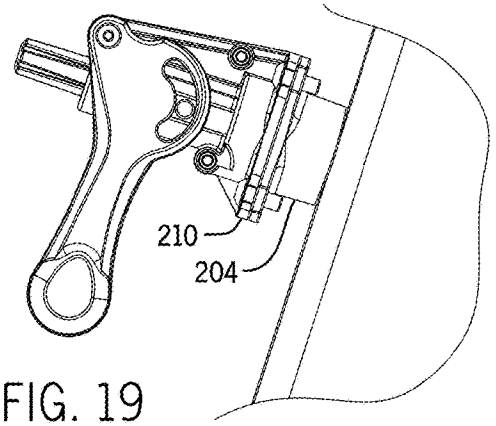
FIG. 19 is a side view of the pin assembly supported on a pin tube coupled with a tube (e.g. seat tube or head tube)
Figure 18A:
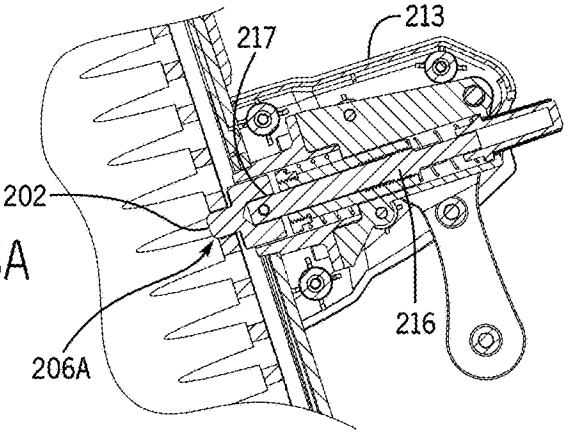
Figure 18C:
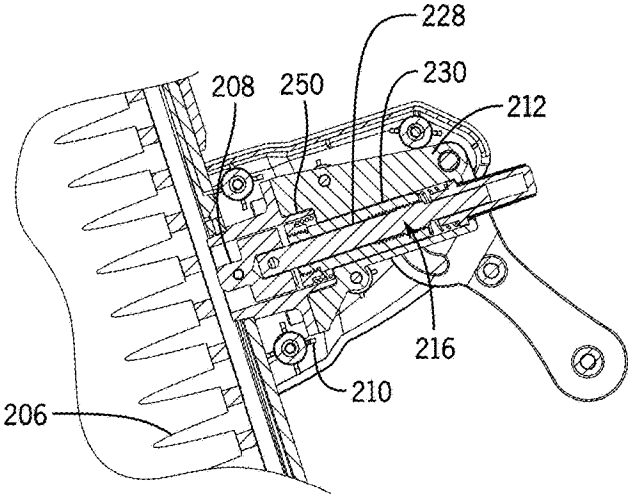

FIG. 18A illustrates the pop pin in a neutral position, FIG. 18B illustrates the pop pin in a clamped (engaged or over-center) position, and FIG. 18C illustrates the pop pin in a release (or unengaged). In the unengaged position, the stem (or inner tube) may be moved relative to the outer tube (e.g., the seat may be raised or lowered). As shown, in the unengaged position, the lever is pivoted away from the tubes and the pin and drive shaft are withdrawn. When the tubes are adjusted, the user may release the lever, and the spring 246 will push the drive shaft outward along with the pin. When the pin is aligned with a hole, the spring force will cause the pin to push into the hole as shown in FIG. 18A. To then clamp the tubes together, the user may push the lever arm toward the tubes forcing the collar against the inner tube wall and causing it to abut the adjacent wall of the outer tube thereby clamping the tubes together to eliminate or substantially reduce wobble or any slop between the tubes. When the pin is properly adjusted relative to the shaft, the user will apply a force sufficient to push the inner tube rearward and the cam roller will move along the cam slot until it is positioned in the most downward portion of the cam slot (or most upward if the cam slot, handle orientation were reversed—handle oriented upward). If the collar includes an O-ring, the compression of the O-ring when the lever is fully engaged helps set the pin and the lever in the fully engaged position, and assist the cam roller in going over center in the cam slot. The center position is proximate the fully extended (locking position) but not at the end of the slot end. The center position is illustrated in FIG. 14, where the arc of the cam pushes the cam roller the furthest forward compressing the O-ring. Stated differently, in the center position, the pin may be tightly pressed against the inner tube wall and pressing it tightly against the outer tube such that the O-ring is compressed. When the lever is fully in the engaged (locking or over-center) position, the compression of the O-ring is relaxed slightly while the pin maintains the tight clamping of the tubes. In the over-center position, the cam slot pushes the drive shaft slightly less forward relative to the center position. The over-center position prohibits the spring force on the drive shaft from back-driving the drive shaft. Thus, a user must pull the lever to remove the drive shaft.

Figure 20A:
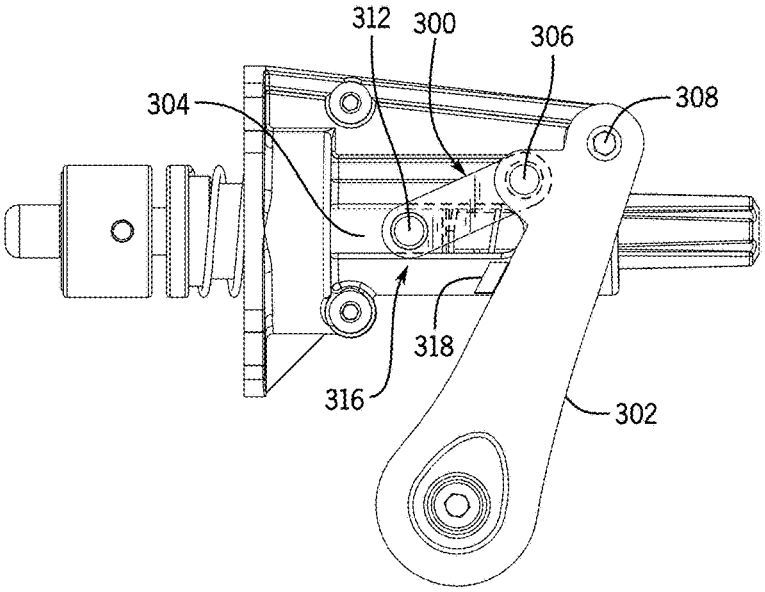
FIGS. 20A and 20B are views of an alternative lever assembly in an engaged (over-center position) and a release position, respectively, the lever assembly including an over-center linkage.
Figure 20B:
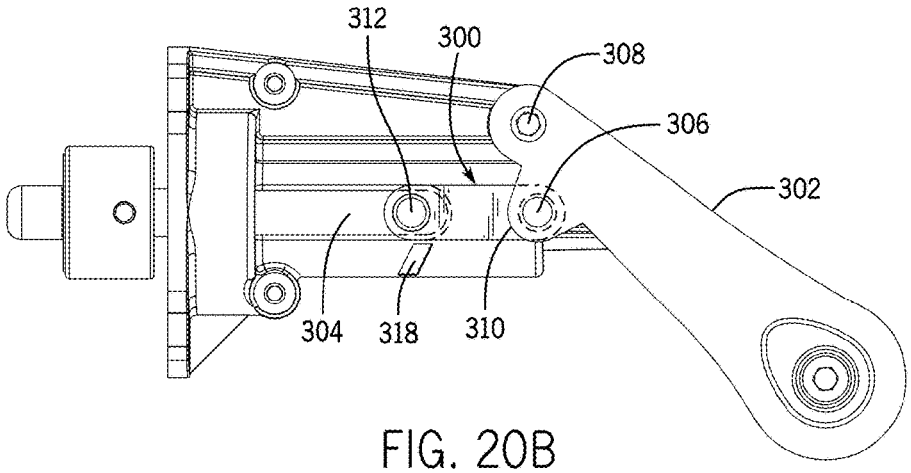

In place of a cam follower arrangement as discussed above, a link or links may be placed between the lever and the drive shaft. FIG. 20A is a side view of a pop-pin assembly in a locked (over-center) engaged position and FIG. 20B is a side view of the pop-pin assembly in the unlocked (disengaged) position. Many of the components are the same or similar to the embodiments discussed above with the exception of the over-center linkage. As shown, a link 300 is coupled between the lever 302 and the drive shaft 304. More specifically, the lever includes a link pivot or axle 306 proximate a lever axle 308. The link pivot is positioned on an ear 310 extending forwardly from the lever. In a position like the cam roller, a second link pivot 312 is connected with the drive shaft 304. The pivot may extend through a slot 316 in a fashion similar to the cam roller.

In the disengaged position, the link is aligned with the drive shaft. Pressing forward (toward the members), places a forward and upward force on the link, which force translates to pushing the drive shaft (and pin) forwardly to engage the pin. As the lever is pushed forward (against the spring force on the drive shaft), the link pivots upwardly and through a path defined by the path of the link pivot 306 in an arc about the lever axle 308. The center position, which may also compress an O-ring or other resilient member of the pin or other member pressing on the tubes, is where the three axles (306, 308 and 312) align as shown in FIG. 20B. A lever stop 318 is positioned to allow the lever to rotate slightly past the alignment (over center orientation), which takes a slight amount of force off the pin but keeps the members locked together. Additionally, by going over center, the over-center linkage prohibits the spring force from back-driving the drive shaft. As with the cam follower embodiment, a user must pull the lever to remove the shaft and disengage the pop-pin.

Figure 28:
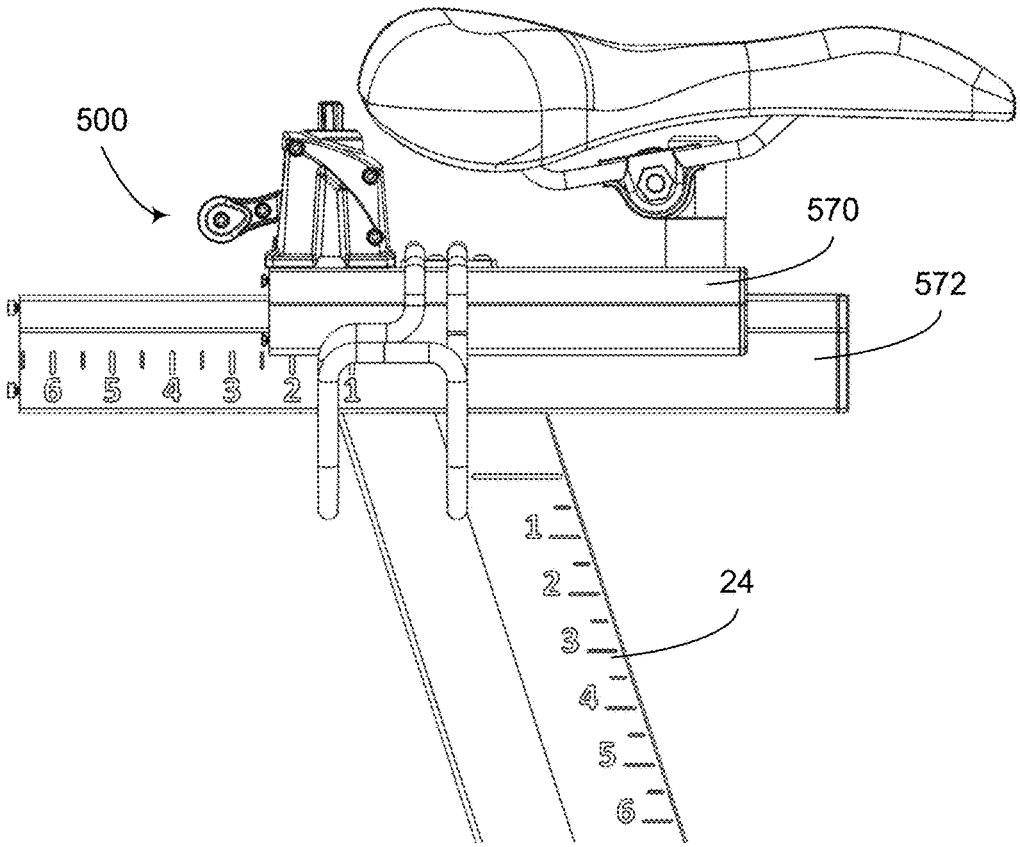
FIG. 28 is a side view of a seat of an exercise bicycle including an alternative implementation of a pop pin assembly.
Figure 29:
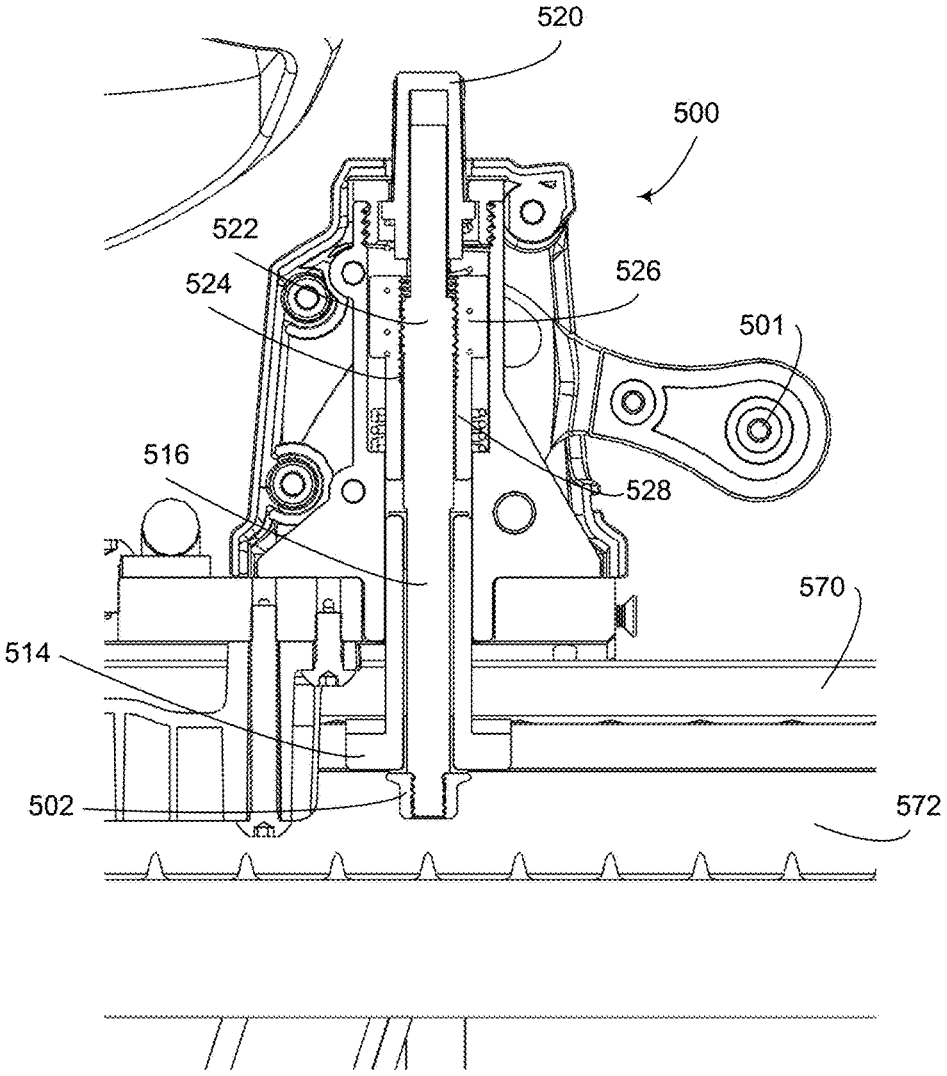
FIG. 29 is a cross-sectional view of the pop pin assembly of FIG. 28.

FIGS. 28-29C illustrate an alternative implementation of a pop pin 500 according to the present disclosure. Similar to the pop pin 26 illustrated and discussed in the context of FIGS. 14-19, the pop pin 500 may be implemented in an exercise machine, such as a stationary bicycle, and functions as an over-center clamp for securing frame members relative to each other. The pop pin 500 may be used, for example, to adjust a seat height (like the pop pin 26 shown FIG. 1) or to adjust a handle bar height (such as the pop pin 52, also shown in FIG. 1). As shown in FIG. 28, the pop pin 500 may also be used to adjust the horizontal position of a seat 18. Accordingly, the following discussion regarding the construction and functioning of the pop pin 500 is not limited to the horizontal seat adjustment example discussed. Rather, the details regarding the pop pin 500 may be readily adapted to enable relative fixation between any suitable members of an exercise machine.

Referring to FIG. 28, the pop pin 500 may be coupled to a first member 570 that is slidable along a second member 572 coupled to a seat post 24 of the exercise machine. For example, the first member 570 may be a bracket slidable along the second member 572 or the first seat member 570 may be a tubular body that extends about and is slidable along the second member 572. Regardless of how the members are slidably engaged, however, the pop pin 500 may be selectively actuated to lock the first member 502 relative to the second member 504, as discussed below in more detail.

FIG. 29 is a cross-sectional view of the pop pin 500 in which the first member 570 is operably fixed relative to the second member 572. Similar to the pop pin 26 illustrated in FIGS. 14-19, the pop pin 500 includes a pin 502 movable in response to actuation of a clamp lever 501 to selectively engage the pin 502 with a corresponding hole disposed along the length of the second member 572. The pin 502 is coupled to the lever 501 such that the pin 502 translates in response to actuation of the lever 501. The pin 502 is generally movable between at least a first position in which the pin 502 is fully removed from the hole allowing relative movement between the first member 570 and the second member 572 and a second position (as illustrated in FIG. 29) in which the first member 570 is locked relative to the second member 572.

As illustrated, the pin 502 extends through or from a pin collar 514 such that the pin collar 514 abuts and presses against the second member 572 when the pop pin 500 is engaged. As a result, the second member 572 is retained by both insertion of the pin 502 into the second member 572 and by frictional engagement between the first member 570 and the second member 572 resulting from the force applied to the second member 572 by the pin collar 514. By frictionally engaging the first member 570 and the second member 572 using the pin collar 514, looseness or "play" between the first member 570 and the second member 572 that may exist when engaging using only the pin 502 may be substantially reduced, thereby improving the stability of the fixation between the first and second members 570, 572. In certain other implementations, the portion of the pin 502 extending from the pin collar 514 may be omitted such that engagement between the first member 570 and the second member 572 is based on the application of pressure by the pin collar 514 only.

An adjustment shaft 516 may be connected to the pin 502 to facilitate longitudinal adjustment of the pin 502. Alternatively, one or a pair of spring-loaded ball detents may be defined in the adjustment shaft whereby the ball portion couples the adjustment shaft 516 to apertures in the pin collar 514. In yet another alternative, a retaining pin may be threaded and engage a corresponding threaded bore in the adjustment shaft 516. Regardless of the mechanism, however, the adjustment shaft 516 is coupled with the pin 502 such that rotation of the adjustment shaft 516 causes longitudinal adjustment of the pin 502 relative to the rest of the pop pin 500. For example, in certain implementations an adjustment knob 520 may be coupled to the shaft 516 and a threaded portion 522 of the adjustment shaft 516 may engage a corresponding threaded bore 524 defined in a drive shaft 526. The adjustment shaft is translationally and rotatably supported in a smooth bore portion 528 of the drive shaft 526 such that by rotating the knob 520, the adjustment shaft 516 rotates and, through the interaction between the threaded portion 522 and the threaded bore 524, finely adjusts the position of the adjustment shaft 516 and pin 502 relative to the drive shaft 526. By adjusting the position of the adjustment shaft 516, a user can change the pressure with which the pin collar 514 presses against the second member 572 and, as a result, the tightness of the connection between the first member 570 and the second member 572. So, for example, if some looseness exists between the members 570, 572 when the pop pin 500 is engaged, the user may rotate the knob 520 to translate the pin 502 and the pin collar 514 toward the second member 570, thereby increasing pressure applied to the second member 570 by the pin collar 514 when the pop pin 500 is engaged. By doing so, the frictional engagement between the members 570, 572 is increased and the looseness between the members 570, 572 may be reduced or eliminated.

Figure 15:
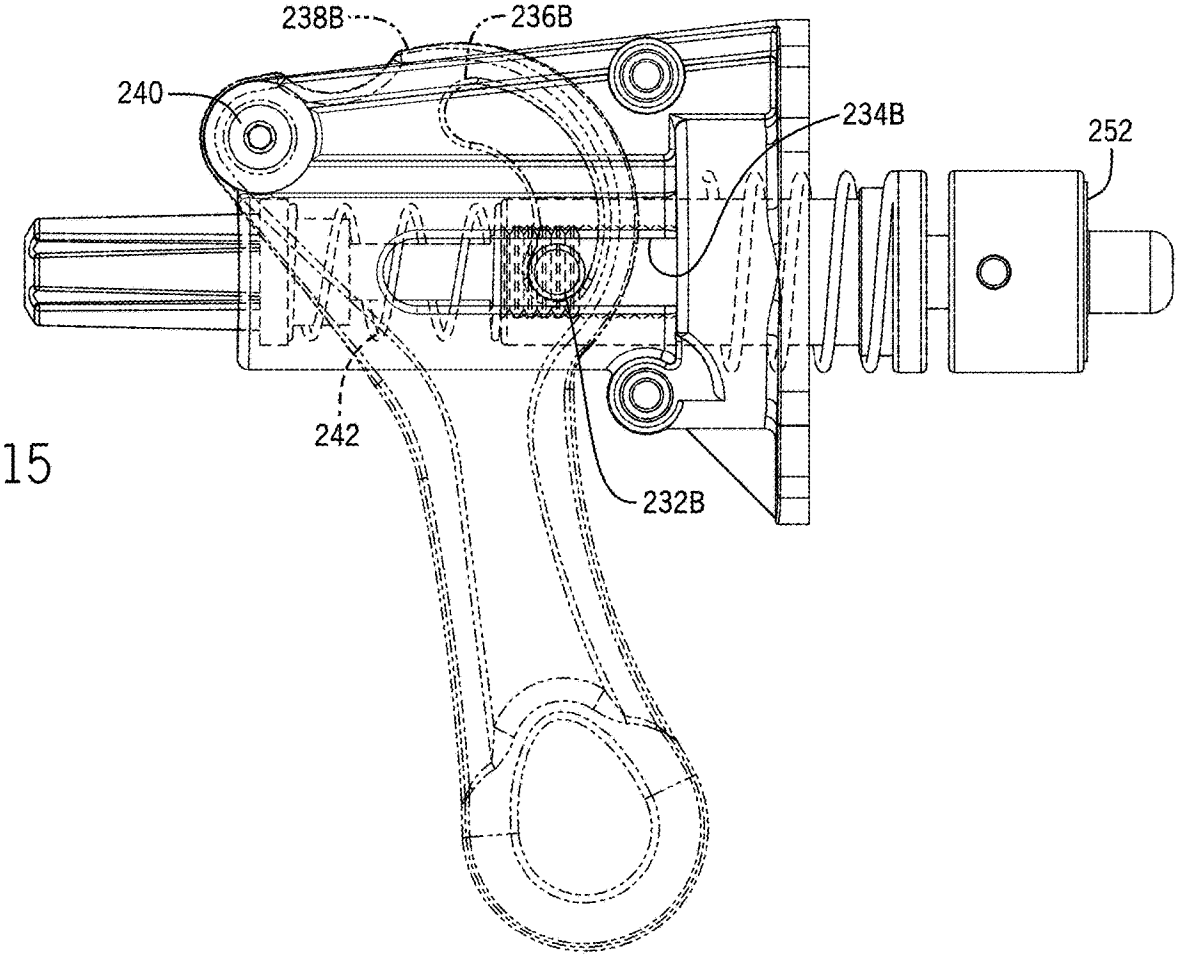
FIG. 15 is an opposing side view of the pin assembly.
Figure 16:
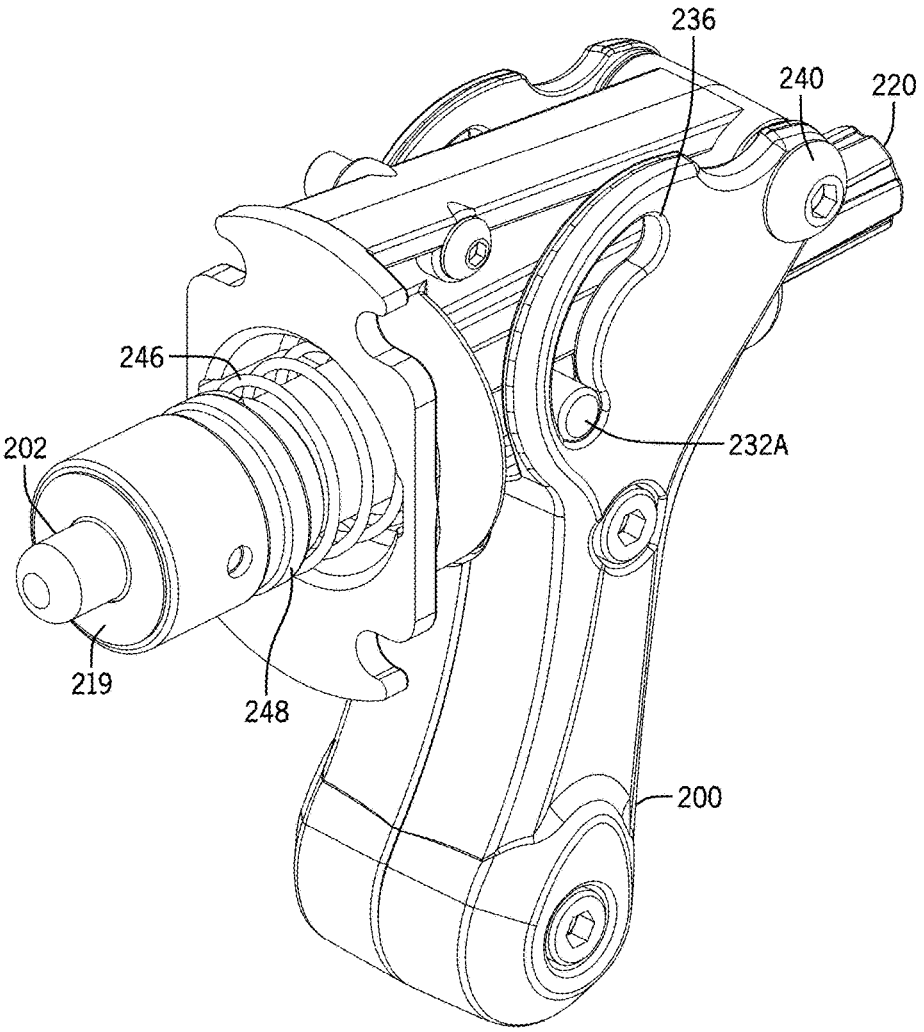
FIG. 16 is an isometric view of the pin assembly.
Figure 17:
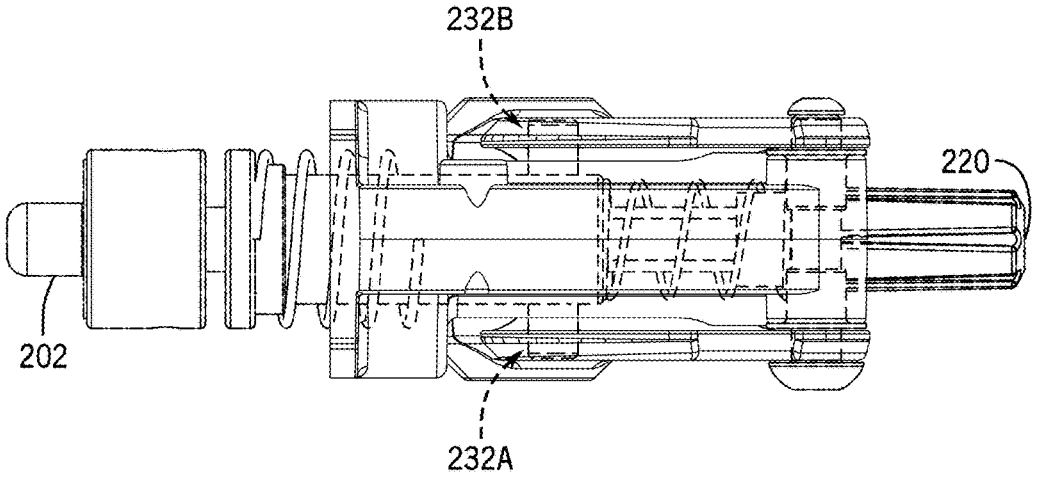
FIG. 17 is a top view of the pin assembly.

Referring back to the pop pin 26 of FIGS. 14-19, the pop pin 26 is generally actuated by movement of the lever 200 via a cam system. As shown in FIGS. 18A-180, the lever 200 is pivotally movable between a first or locked position (shown in FIG. 18B) and a second or unlocked position (shown in FIG. 18C). When in the first position, the lever 200 is disposed toward the members being fixed while in the second position the lever 200 is disposed away from the members being fixed. In other words, the drive shaft 226 and lever 200 of the pop pin 26 are coupled together such that when the lever 200 is pivotally moved the lever 200 and the drive shaft 226 move substantially the same direction, i.e., toward or away from the members being fixed. As illustrated in FIGS. 14-15, this effect is achieved by disposing cam slots 236A, 236B of the lever 200 between the pivot axle 240 of the lever 200 and the members.

In contrast to the pop pin 26 of FIGS. 14-19, the pop pin 500 operates in a generally opposite manner such that moving the lever 501 away from the members 570, 572 causes the pin 502 and pin collar 514 to engage the second member 572 while moving the lever 501 toward the members 570, 572 causes the pin 502 and pin collar 514 to disengage from the members. Such an arrangement may be beneficial in situations in which a user of the exercise machine may more easily apply a pulling force on the lever 501. For example, when the pop pin 500 is implemented to adjust the horizontal position of a seat, such as illustrated in FIG. 28, it is generally easier for a rider sitting in the seat to secure the pop pin 500 by applying an upward force on the lever 501.

Figure 30C:
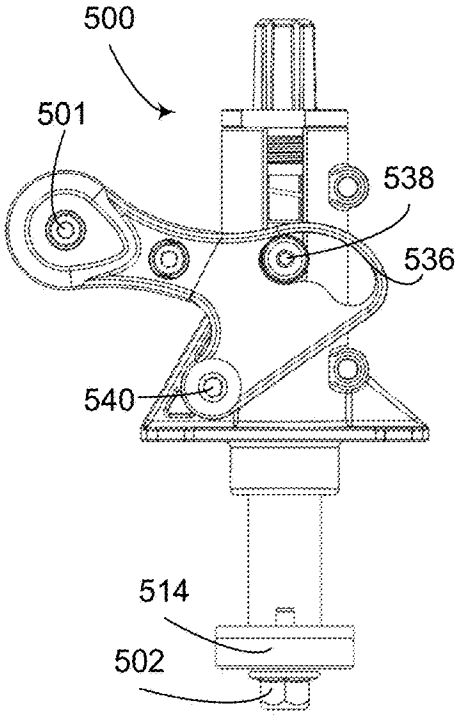
FIGS. 30A-30C illustrate the pop pin assembly of FIG. 28 in a disengaged, intermediate, and engaged state, respectively.
Figure 30B:
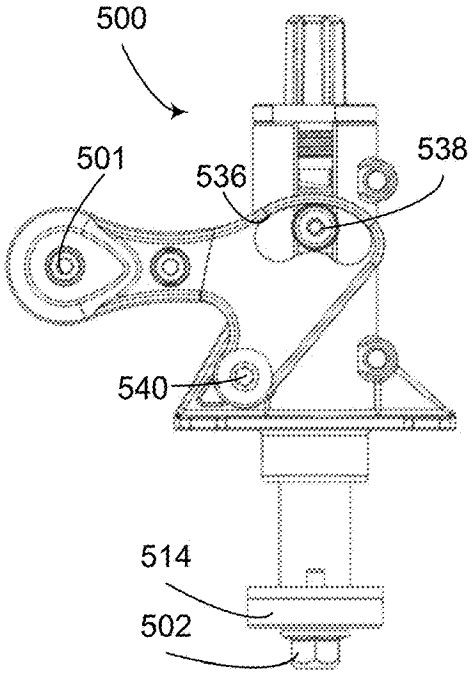
Figure 30A:
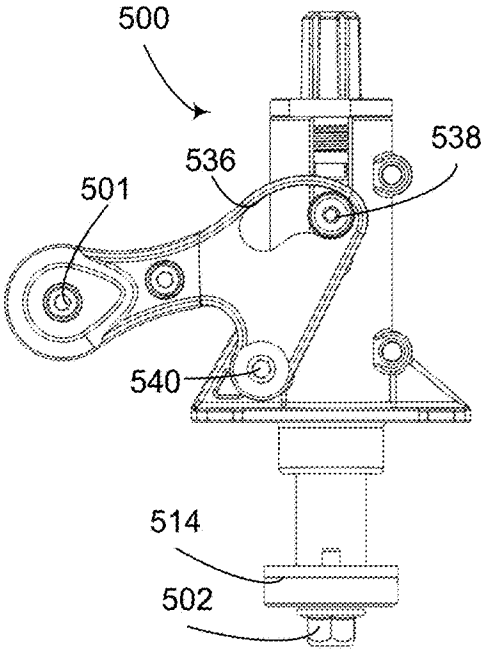

The transition of the pop pin 500 from the disengaged state to the engaged state is illustrated in FIGS. 30A-300, which are side views of the pop pin 500 with corresponding structures of the exercise machine to which the pop pin 500 is coupled removed for clarity. As illustrated, the lever 501 is coupled to a housing 512 of the pop pin 500 by a pivot axle 540. For example, the lever 501 may include a pair of opposite ears, such as ear 538, disposed on opposite sides of the housing 512 and coupled to the housing by the pivot axle 540. Each of the ears may further define a cam slot, such as cam slot 536, within which a corresponding cam roller, such as cam roller 538, is disposed. Each cam roller is in turn coupled to the drive shaft 526 (shown in FIG. 29) of the pop pin 500 such that as the lever 501 is pivotally moved about the pivot axle 540, the cam rollers are moved by interacting with their respective cam slots, resulting in translation of the drive shaft 526. Such movement is illustrated in the transition between FIGS. 30A-300 with FIG. 30A illustrating the pop pin 500 in an initial disengaged/unlocked state in which the pin 502 is fully retracted, FIG. 30B illustrating the pop pin 500 in an intermediate state, and FIG. 30C illustrating the pop pin 500 in an engaged/locked state in which the pin 502 is fully extended.

As previously discussed, the pop pin 500 is configured so the drive shaft 526 translates in a generally opposite direction of the lever 501 when the lever 501 is actuated. As a result, engagement of the pop pin 500 is achieved by pulling the lever 501 away from the members being fixed. This effect is achieved by disposing the pivot axle 540 ahead of the cam system as opposed to behind the cam system as was the case in the pop pin 26 of FIGS. 14-19.

Although various representative embodiments of this disclosure have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments and do not create limitations, particularly as to the position, orientation, or use of the disclosure unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. An exercise machine comprising:

a frame supporting a rotating member;

a resistance element moveable between at least a first resistance element position and a second resistance element position, the first resistance element position associated with a first resistance on the rotating member and the second resistance element position associated with a second resistance on the rotating member, the second resistance being different than the first resistance; and a resistance adjustment assembly comprising:

a shaft coupled to the resistance element and translatable relative to the frame between a first shaft position and a second shaft position, the first shaft position corresponding to the first resistance element position and the second shaft position corresponding to the second resistance element position; and a lever assembly operably coupled with the shaft, the lever assembly independently rotatable from the shaft between a first lever position and a second lever position to translate the shaft between the first shaft position and the second shaft position.

2. The exercise machine of claim 1, wherein the shaft is independently rotatable from the lever assembly and such independent rotation of the shaft translates the shaft relative to each of the frame and the lever assembly.

3. The exercise machine of claim 1, wherein the shaft is independently translatable from the lever assembly in a first direction.

4. The exercise machine of claim 1, wherein the shaft is biased in a second direction opposite the first direction.

5. The exercise machine of claim 1, wherein the resistance element comprises at least one of a magnetic resistance element or a frictional resistance element.

6. The exercise machine of claim 1, wherein the rotating member is a wheel of the exercise machine.

7. The exercise machine of claim 1, wherein the resistance adjustment assembly further comprises a member operatively fixed relative to the frame and including a plurality of surfaces longitudinally offset relative to each other, the lever assembly further comprises at least one projection, in the first lever position the at least one projection abuts a first surface of the plurality of surfaces, and in the second lever position the at least one projection abuts a second surface of the plurality of surfaces.

8. An exercise machine comprising:

a frame supporting a wheel;

a brake arm pivotally coupled with the frame and moveable between at least a first position and a second position, the brake arm including at least one resistance element positioned proximate the wheel, and the first position associated with a first braking force on the wheel and the second position associated with a second braking force on the wheel, the second braking force greater than the first braking force; and a brake arm adjustment assembly comprising:

a housing coupled with the frame, the housing translationally and rotatably supporting a shaft;

a member operably fixed relative to the housing, the member defining a first surface separated from a second surface by a distance relating to a separation between the first position and the second position;

a lever assembly including at least one projection, the lever assembly moveable relative to the housing to selectively move the at least one projection from engaging the first surface to engaging the second surface; and a spacer disposed between the lever assembly and the shaft, the lever assembly abutting the spacer and rotatable about the spacer, wherein movement of the lever assembly causes the shaft to translate the distance separating the first surface and the second surface and move the brake arm from the first position, associated with the first surface, to the second position, associated with the second surface.

9. The exercise machine of claim 8, wherein the spacer is interlocked with the member such that the spacer is rotationally fixed relative to the member.

10. The exercise machine of claim 9, wherein the spacer is translatable relative to the member when interlocked with the member.

11. The exercise machine of claim 9, wherein the member comprises at least one first boss and the spacer comprises at least one corresponding second boss, the interlocking resulting from mating of the at least one first boss with the at least one second boss.

12. The exercise machine of claim 8, wherein the housing defines a slot and the spacer comprises a tab disposed within the slot such that the spacer is rotationally limited by the slot.

13. The exercise machine of claim 8, further comprising a lateral support coupled to the shaft and abutting a distal face of the spacer.

14. The exercise machine of claim 8, wherein the spacer comprises a cylindrical body and a spacer flange extending outwardly from the cylindrical body, the spacer flange abutting a distal surface of the lever assembly.

15. The exercise machine of claim 8, wherein the housing defines a tab and the housing defines a slot within which the tab is disposed, the tab rotationally fixing the member relative to the housing.

16. The exercise machine of claim 8, further comprising a biasing element biasing the member into the lever assembly.

17. An exercise apparatus comprising:

a first member;

a frame comprising a second member, the first member moveably supported by the frame relative to the second member; and a locking assembly coupled with the second member, the locking assembly comprising:

a shaft including an engagement portion positioned to engage the first member to fix the first member relative to the second member;

a cam roller coupled to the shaft;

a drive shaft defining a passage receiving the shaft, the shaft adjustably supported within the passage such that the shaft is translatable within the passage relative to the drive shaft; and a lever defining a cam slot and coupled to the drive shaft by insertion of the cam roller into the cam shaft, the lever pivotally supported by a pivot axle such that the lever is pivotal between a first lever position where the drive shaft is driven toward the first member to fix the first member relative to the second member and a second lever position where the drive shaft is released from driving the first member such that the first member may be moved relative to the second member.

18. The exercise apparatus of claim 17, wherein the cam roller and the cam slot are disposed between the pivot axle and the second member such that the lever is pivotal from the first position to the second position by pivoting the lever toward the second member.

19. The exercise apparatus of claim 17, wherein the pivot axle is disposed between the second member and the cam roller and cam slot such that the lever is pivotal from the first position to the second position by pivoting the lever away from the second member.

20. The exercise apparatus of claim 17, wherein the engagement portion includes at least one of a pin shaped to be received by a corresponding hole of the second member when the lever is in the first lever position or a collar adapted to apply pressure against the second member to frictionally engage the second member to the first member when the lever is in the first lever position.

* * * * *